US005867149A

United States Patent [19]

Jaeger

[11] Patent Number: 5,867,149

[45] Date of Patent: Feb. 2, 1999

[54] SWITCH KEY IMAGE DISPLAY AND OPERATOR/CIRCUIT INTERFACE

[75] Inventor: Denny Jaeger, Oakland, Calif.

[73] Assignee: Intertactile Technologies Corporation, Oakland, Calif.

[21] Appl. No.: 514,572

[22] Filed: Aug. 14, 1995

[51] Int. Cl.[6] ..... G09G 5/00; H01H 13/06; H01H 9/00

[52] U.S. Cl. ..... 345/172; 345/170; 349/1; 200/302.2; 200/314

[58] Field of Search ..... 345/168, 170, 345/172, 173, 184, 51, 108; 341/22, 23–34; 313/503; 348/734; 340/815.56; 200/302.2

[56] References Cited

U.S. PATENT DOCUMENTS

| | | | |
|---|---|---|---|
| 3,798,611 | 3/1974 | Gallant et al. | 340/172.5 |
| 3,825,923 | 7/1974 | Pirchl | 345/108 |
| 4,022,993 | 5/1977 | Shattuck | 345/173 |
| 4,110,664 | 8/1978 | Asars et al. | 315/169 TV |
| 4,117,542 | 9/1978 | Klausner et al. | 364/900 |
| 4,156,833 | 5/1979 | Wey et al. | 340/719 |
| 4,352,959 | 10/1982 | Warnecke et al. | 345/173 |
| 4,551,717 | 11/1985 | Dreher | 340/712 |
| 4,633,227 | 12/1986 | Menn | 340/365 |
| 4,687,300 | 8/1987 | Kubo et al. | 345/51 |
| 4,746,198 | 5/1988 | Baeger | 350/366 |
| 5,031,046 | 7/1991 | Briiggemann | 348/734 |
| 5,067,021 | 11/1991 | Brody | 358/241 |
| 5,128,672 | 7/1992 | Kaehler | 341/23 |
| 5,134,505 | 7/1992 | Tanaka et al. | 359/48 |
| 5,300,858 | 4/1994 | Nikaido | 313/503 |
| 5,340,955 | 8/1994 | Calvillo et al. | 200/302.2 |
| 5,404,133 | 4/1995 | Moriike et al. | 340/815.56 |
| 5,430,267 | 7/1995 | Ozeki et al. | 200/302.2 |
| 5,515,045 | 5/1996 | Tak | 341/23 |
| 5,559,512 | 9/1996 | Jasinski et al. | 341/22 |
| 5,612,692 | 3/1997 | Dugas et al. | 341/22 |

FOREIGN PATENT DOCUMENTS 2038055 7/1980 United Kingdom .

OTHER PUBLICATIONS

US Appln. SN 08/644,888, filed May 10, 1996 which is entitled Circuit Control Devices Displaying Changeable Graphics.

US Appln. SN 08/644, 794, filed May 10, 1996 which is entitled Flat Panel Display with Optical Signal Transparent Zone.

US Appln SN 08/644,796, filed May 10, 1996 which is entitled Circuit Control Panel Displaying Changeable Graphics.

US Appln. SN 08/644,795, filed May 10, 1996 which is entitled Circuit Control Panel with Variable Graphics Display.

(List continued on next page.)

*Primary Examiner*—Jeffery Brier
*Assistant Examiner*—David L. Lewis
*Attorney, Agent, or Firm*—Harris Zimmerman

[57] ABSTRACT

Keys or buttons for operating switches contain flat panel displays for displaying changeable images that convey information pertaining to operation of the switches. Labels at the face of the keys can change instantly and automatically when the functions of the switches change during different modes of operation of an electronic system. The display including driver integrated circuit chips is contained within a transparent key cap and has a bezel free construction enabling display of images that may extend to the edges of the face of the display. The invention provides for durable moisture sealing at the edges of a display which contains very thin internal edge seals and, in one form, provides similar sealing at a passage through the active image area of the display through which a switch button or other control may extend. A single set of such keys may be used to control diverse different types of electronic devices. Labels displayed by the set of keys change when the operator switches from control of one such device to control of another.

20 Claims, 15 Drawing Sheets

OTHER PUBLICATIONS

US Appln. SN 08/703,416, filed Aug. 26, 1996 which is entitled Operator/Circuit Interface with Integrated Display Screen.

US Appln. SN 08/702,978, filed Aug. 26, 1996 which is entitled Operator/Circuit Interface with Integrated Display Screen.

US Appln. SN 08/703,186, filed Aug. 26, 1996 which is entitled Operator/Circuit Interface with Integrated Display Screen.

US Appln. SN 08/703,418. filed Aug. 26, 1996 which is entitled Operator/Circuit Interface with Integrated Display Screen.

US Appln. SN 08/703,419, filed Aug. 26, 1996 which is entitled Operator/Circuit Interface with Integrated Display Screen.

US Appln. SN 703,417, filed Aug. 26, 1996 which is entitled Operator/Circuit Interface with Integrated Display Screen.

US Appln. SN 08/725,201, filed Sep. 20, 1996 which is entitled Rotary Circuit Control Devices with Changeable Graphics.

US Appln. SN 08/763,132, filed Dec. 10, 1996 which is entitled Integrated Display Screen and Slidable Control for Electrical Circuits.

US Appln. SN 08/909,114, filed Aug. 11, 1997 which is entitled Rotary Circuit Control Devices with Changeable Graphics.

US Appln. SN 08/917,194, filed Aug. 25, 1997 which is entitled Multiple Purpose Controls for Electrical Systems.

SWITCH KEY IMAGE DISPLAY AND OPERATOR/CIRCUIT INTERFACE

TECHNICAL FIELD

This invention relates to apparatus for enabling operator interaction with electronic devices. The invention further relates to keys or buttons for manually operating switches or the like and more particularly to keys which display changeable images that convey information pertinent to operation of a switch or the like.

BACKGROUND OF THE INVENTION

Switch keys and other manually actuated components for enabling operator interaction with an electrical circuit are usually provided with a label or symbol that identifies the function of the key or the like. It is advantageous if the label or symbol appears on the key cap itself as this avoids errors in associating a particular label with a particular key. The labels are necessarily located on the key caps in instances where a plurality of keys are arrayed in adjacent relationship with each other such as in a computer keyboard for example.

Traditional practice has been to provide permanent imprinted labels on key caps. This complicates operation of switch keys in instances where the same switch is used for different purposes at different times. A computer keyboard is again an example of an electronic device in which problems of this kind arise. Individual function keys on the computer keyboard are used to enter different instructions to the computer during different modes of operation of the system. Alphanumeric keys, which are used to enter letters or numbers, may have alternate functions when operated in conjunction with other keys. The function of a particular key may depend on the particular software that is being run.

The operator of a keyboard in which keys are permanently imprinted with a single label or a small number of labels must typically memorize alternate functions of different keys or repeatedly consult a list of such functions. This complicates the process of learning to operate the keyboard, slows operation and tends to promote operator error.

It is possible to provide a template which extends alongside certain keys and which is imprinted with words or symbols that identify alternate functions of the keys. This is not an ideal solution to the problem as the words or symbols are not situated directly on the keys and the operator's attention must be momentarily diverted from the actual keys to inspect the template. A template of this kind can only be used in conjunction with keys which are separated from the main bank of keys or which are at certain locations at the periphery of the bank of keys.

It has heretofore been recognized that operation of keys or switch buttons which have multiple functions can be facilitated by embedding small flat panel displays in the key caps which displays are of the type that electronically generate changeable images. The labels or symbols displayed by the key can then be made to change when the function of the key changes.

The traditional flat panel display construction is not ideally suited for this purpose. The active image generating area of such displays is bounded by a sizable bezel region which contains moisture seals, electrical conductors and other components. Thus the image display area is smaller than the overall area of the display panel. This severely constricts the size of the displayed images in instances where the display panel is very small as is the case where it is to be embedded in a switch key cap. The face of a key may, for example, measure one half inch by one half inch. The bezel region at each edge of prior flat panel displays is at least one eighth inch to one fourth inch wide. Such a bezel would leave little or no usable viewing area on a one half inch square display. The display would have an undesirably limited information content or none at all.

One prior flat panel display technology provides image display areas that extend to the edges of the panels. For several reasons, prior displays of this kind are not particularly suited for use in small switch caps. For example, the seals at the edges of a flat panel display of this kind should be extremely thin as seals having a thickness in excess of about ten mils create a noticeable bezel around the margins of the image display area. In the absence of the present invention, seals this thin may deteriorate over a period of time and allow a damaging infiltration of moisture. This shortens the usable life of the key and can cause line outs in the image.

Components of prior flat panel displays which produce images that are coextensive with the face of the panel are not arranged and interrelated in a manner that is susceptible to miniaturization of the device for inclusion in a small switch key, at least in instances where high resolution images are to be produced. Use in a switch key cap requires that integrated circuit chips and a large number of minute conductors for interconnecting the chips with pixel defining busbars of the display all fit within the confined region behind the face of the switch cap and that they be arranged in a manner which enables the numerous electrical interconnections to be established in a reliable manner.

Considering another aspect of the background of the invention, the use of diverse different electronic devices in homes, offices, vehicles and at other locations creates certain complications for the users which have not heretofore been addressed. Each such device has its own set of controls which the user must learn to operate. Duplication of controls adds substantially to the cost and bulk of the electronic devices. In some situations it may be difficult or impossible to find convenient locations for a sizable number of sets of controls for different electronic devices. Automobiles, for example, may be equipped with a radio, a cassette player, a compact disc player and/or any of a variety of other electronic systems. The dashboard of a typical car provides little or no space for a proliferation of additional controls. In a home, electronic devices may be situated at widely spaced apart locations. The user must move from one place to another in order to operate the different devices or, alternately, operate a number of different hand held remote control units.

The present invention is directed to overcoming one or more of the problems discussed above.

SUMMARY OF THE INVENTION

In one aspect, the present invention provides a switch key which displays changeable images pertaining to use of the key. The switch key includes an electronically controlled flat panel display having an optically active layer at which images are generated and in which the optically active layer extends substantially to at least one edge of the flat panel display. A key cap has a transparent face overlaying the flat panel display and has a skirt region which extends along the edge of the flat panel display and which is bonded thereto by moisture impervious bonding material. The key cap and bonding material form a continuous unbroken seal along the edge of flat panel display.

Another aspect of the invention enables electronic circuit controls to extend through the image display area of an electrically controlled flat panel display in a manner which provides a highly durable moisture seal at the passage through which the control extends. The display has a substrate overlaid by an optically active layer at which visible images are generated and has at least a pair of additional layers which include a first additional layer situated between the substrate and the optically active layer and a second additional layer overlaying the optically active layer. A passage extends through the substrate, the optically active layer and the first and second additional layers. A moisture impervious sleeve forms a lining within the passage and is bonded to the adjacent portions of the flat panel display.

In another aspect of the invention, an electrically controlled flat panel display for displaying images has a a substrate with front and back surfaces, a plurality of row busbars extending in parallel relationship with the front surface, a plurality of column busbars which also extend in parallel relationship with the front sur-surface and which cross the row busbars to define an array of image pixels. An optically active layer extends in parallel relationship with the front surface of the substrate and generates images in response to electrical voltages that are applied to ones of said row and column busbars. A driver circuit applies the voltages to the busbars. The driver circuit is divided between four integrated circuit chips situated behind the substrate and which extend in parallel relationship with the substrate, the integrated circuit chips being arranged in a rectangular pattern wherein a first pair of the integrated circuit chips are parallel and spaced apart and a second pair of parallel, spaced apart integrated circuit chips extend at right angles to the first pair. The first pair of integrated circuit chips are electrically connected tp the row busbars at opposite ends thereof and the second pair of microchips are electrically connected to the column busbars at opposite ends thereof.

In another aspect of the invention, an electrically controlled flat panel display for displaying images has a substrate, a layer of row busbars which extend in parallel relationship with the front surface of the substrate and a layer of column busbars which extend in parallel relationship with the front surface of the substrate and which cross the row busbars to define an array of image pixels. An optically active layer extends in parallel relationship with the front surface of the substrate and generates images in response to electrical voltages that are applied to ones of the row and column busbars. A driver circuit applies the voltages to the busbars. The layers of busbars and the optically active layer extend to at least one edge of the substrate. At least portions of the driver circuit are situated at a driver circuit board which is disposed behind the substrate in parallel relationship with the substrate. The display further includes at least one flat strip shaped electrical connector which is disposed against the edge surface of said substrate and which has a plurality of spaced apart parallel electrical conductors embedded in flexible insulative material. The conductors extend across the edge surface of the substrate and connect busbars which end thereat with the driver circuit at the back of the substrate.

In still another aspect, the invention provides an operator/circuit interface for controlling a plurality of different electronic devices with a single set of controls. The interface has a plurality of manually operable electrical switches each having a switch button for actuating the switch and each having contacts which produce an electrical control signal in response to operation of the switch. Each of the switch buttons includes a flat panel display for producing visible images at the button. The interface further includes a microprocessor which directs control signals initiated by operation of the switches to any selected one of the different electronic devices. A flat panel display controller generates changeable images at the flat panel displays of the switch buttons which images indicate the different functions of the switches when the switches are used to control different ones of the electronic devices.

The invention, in one aspect, provides a switch key having an embedded flat panel display which displays a changeable image that is indicative of the function of the key. The image can change instantly and automatically when the function of the key itself is changed. In the preferred form, the displayed image may extend to edges of the display panel to provide large images which are easily read and to provide for greater information content in the images where needed. A transparent key cap extends the life of the key by providing enhanced mositure sealing at the edges of the flat panel display. In another aspect, the invention enables switch buttons or other controls to extend through the active image area of a flat panel display without adverse effects on the durability of the display. Another aspect of the invention provides for inclusion of a flat panel display including driver circuit integrated circuit chips within a small switch key to provide for display of high resolution changeable labels or other images at the face of the key. In still another aspect, the invention provides an operator/circuit interface with which an operator can control a plurality of different electronic devices with a single set of control buttons. Flat panel displays within the control buttons generate images at the buttons which can change instantly and automatically when a different electronic device is to be controlled with the single set of control buttons.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
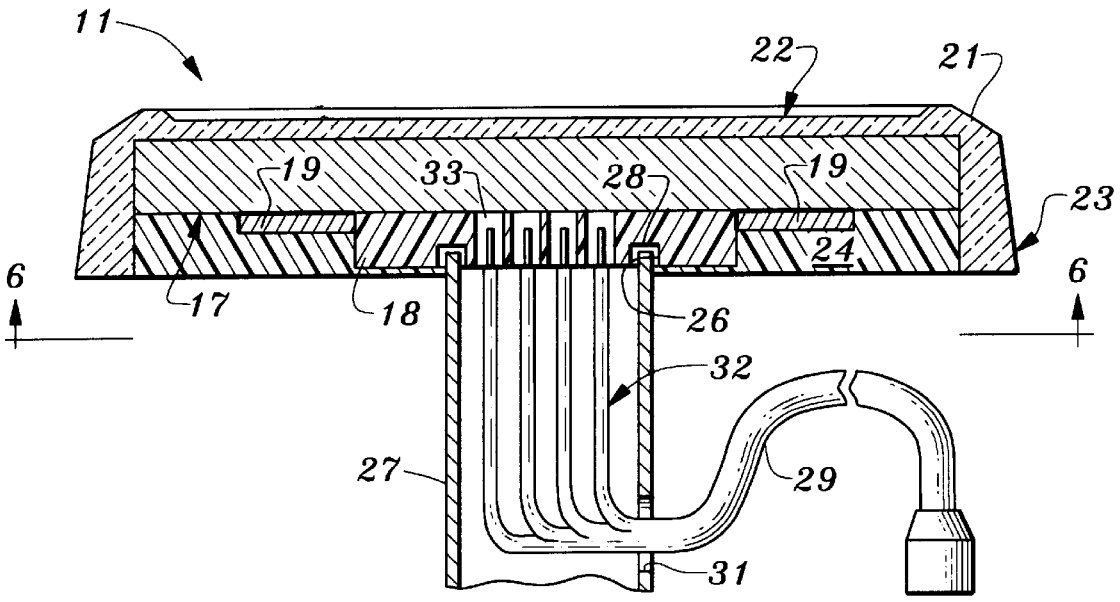
FIG. 1 is a cross section view of a switch key in accordance with a first embodiment of the invention.
Figure 2:
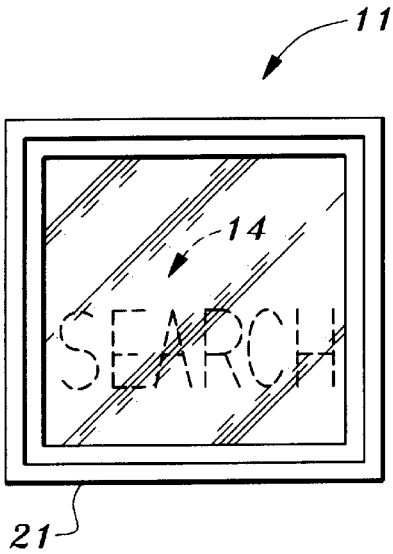
FIG. 2 is a top view of the key of FIG. 1 during a first mode of operation.
Figure 3:
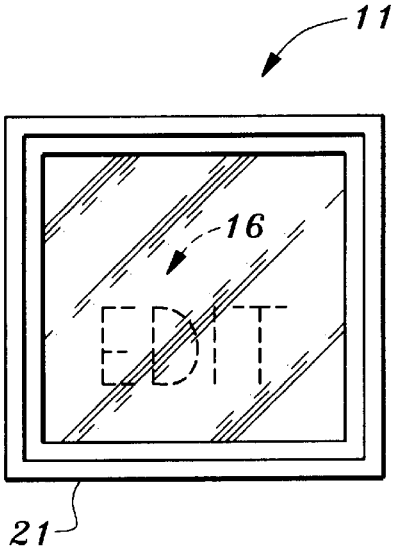
FIG. 3 is a top view of the key of FIG. 1 during a second mode of operation.

Referring initially to FIGS. 1 to 3 of the drawings, the first depicted embodiment of the invention is a switch key 11 of the type that is depressed by an operator in order to close or open electrical switch contacts. The key 11 of this particular example is designed for use as a multiple function key of a computer keyboard but it should be recognized that the invention is equally applicable to keys, switch buttons and the like for diverse other types of electronic device.

A multiple function key 11 is used for different purposes at different times. Permanently imprinted labels or symbols on the key 11 can at best identify only a very small number of the possible functions of the key. The present invention greatly simplifies operation of a keyboard by providing changeable electronically generated images 14, 16 which are visible at the face of the key 11. The images can change instantly and automatically when the function of the key 11 is changed in order to identify the current function of the key at any given time.

For purposes of example FIG. 2 depicts display of an image 14 of the word "SEARCH" which is appropriate when the key 11 is the F2 key of the keyboard of an IBM compatible computer running WordPerfect software during word processing operations. Depression of the F2 key 11 under those conditions initiates a search of the text for a particular word or phrase that is entered by the operator. As shown in FIG. 3, the key 11 may display an image of the word "EDIT" if the word processing software is replaced with Lotus 1-2-3 spreadsheet software as the same key is then used for the different purpose of initiating the edit mode of operation. Images at other keys of the keyboard can be varied in a similar manner to identify changes in the functions of the keys at different times.

Referring again to FIGS. 1, 2 and 3, the images 14, 16 are produced by a small flat panel display 17 within the key 11. The display 17 may be square and measure about 0.5 inch at each side if it is designed for keyboard usage as described above. A square PC (printed circuit) board 18 is adhered to the central region of the underside of display 17. The PC board 18 is smaller in area than the display 17 to enable IC (integrated circuit) chips 19 to be disposed against the underside of the display in an arrangement which will hereinafter be described in more detail.

Display 17, PC Board 18 and IC chips 19 are situated within a key cap 21 which has a transparent face 22 overlaying the display and which has an integral skirt 23 that extends around the sides of the display. Cap 21 has a square configuration conforming with the outline of display 17 and may be an integral body of glass or transparent plastic. Portions of the interior of cap 21 that are not occupied by the display 17, PC board 18 and IC chips 19 are filled with organic sealing material 24 such as epoxy or a glass type of sealing material for example.

PC board 18 has an annular cavity 26 at a centered location on the back of the board into which one end of a tubular switch actuator shaft 27 is entered. A filling 28 of epoxy or other adhesive in cavity 26 secures the key 11 to the shaft 27. To provide electrical connections to the flat panel display 17, a flexible multi-conductor electrical cord 29 extends into an opening 31 in the side of shaft 27. The conductors 32 of cord 29 connect with solder pads 33 situated in PC board 18.

Images displayed by the key 11 are more easily read, are less subject to being misinterpreted and can convey greater amounts of information if the image displaying area of flat panel display 17 extends to edges of the panel. The image display area is preferably coextensive with the face of the display 17. For this purpose, the display 17 has a specialized construction.

Figure 4:
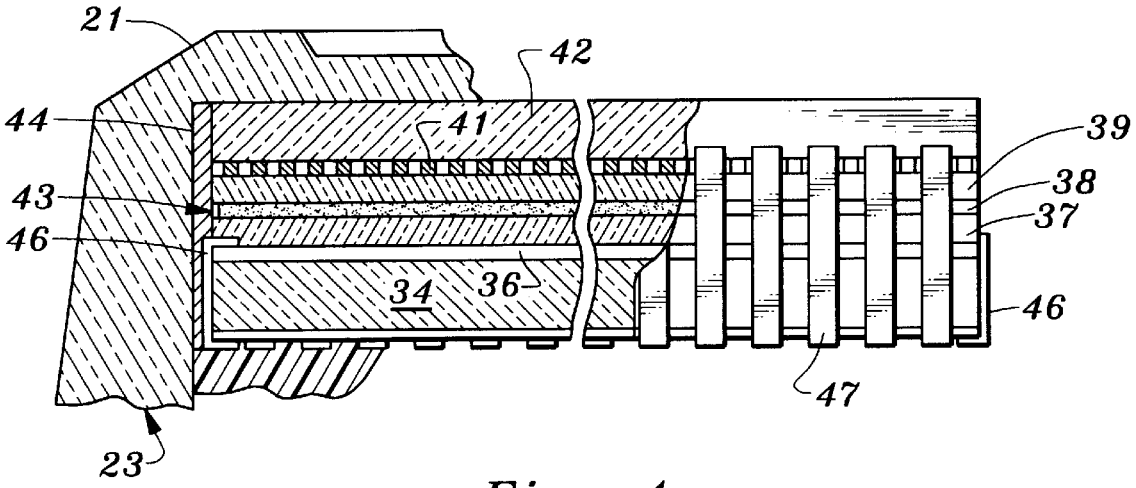
FIG. 4 is an enlarged, broken out and foreshortened side view of the key of the preceding figures.
Figure 5:
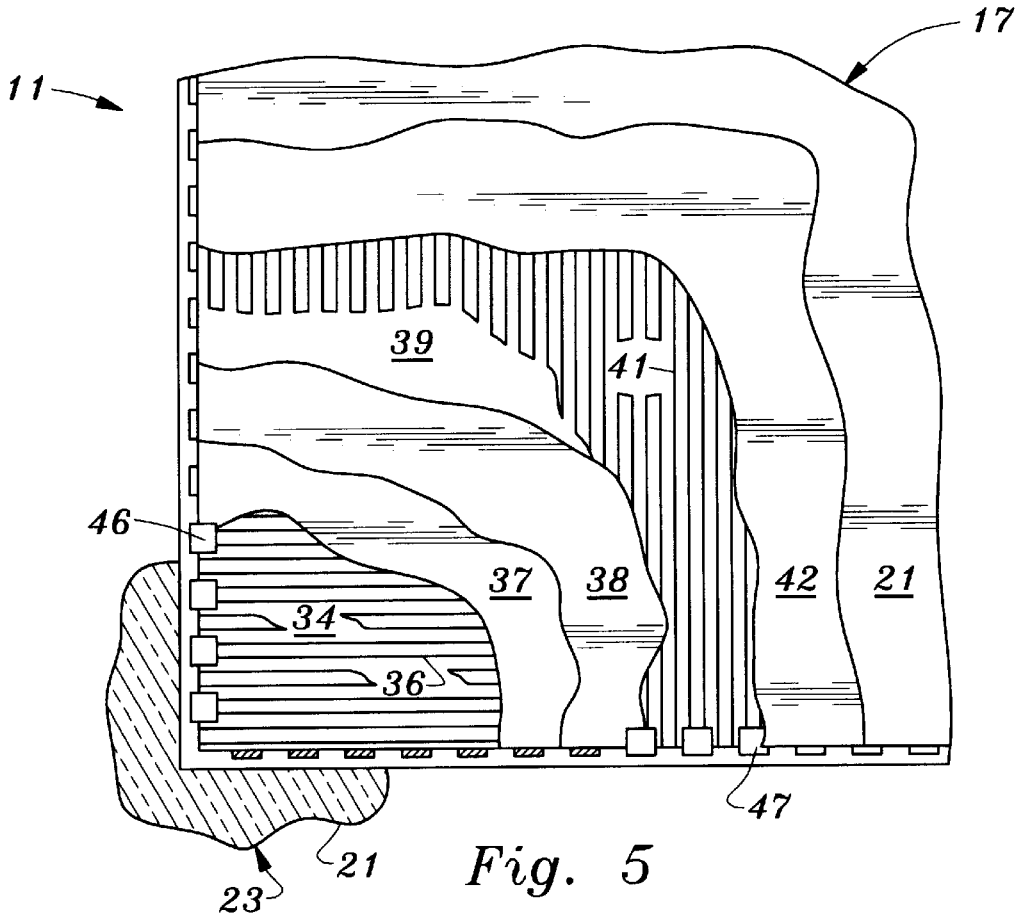
FIG. 5 is a top view of a corner region of the key of the preceding figures, FIG. 5 being broken out to expose successive layers within the body of the key.

In particular, with reference to FIGS. 4 and 5, the flat panel display 17 may basically be of any of the known types such as an active matrix liquid crystal display or an FED, STN, TN, plasma or Cholesteric display among other examples. The display of the present preferred embodiment is of the TFEL (thin film electro-luminescent) type. A TFEL display 17 has a layered construction which includes a flat glass or ceramic substrate 34 at the back of the display. Substrate 34 is, in sequence, overlaid by a layer of row busbars 36, a first dielectric layer 37, a phosphor layer 38, a second dielectric layer 39, a layer of column busbars 41 and a sealing and passivation layer 42 of polymer which forms the face of this particular display. Suitable materials for forming the several layers 36, 37, 38, 39, 41 and 42 are known to the art.

At least the layers 39, 41 and 42 that are in front of the phosphor layer 38 are formed of light transparent material. The row busbars 36 are spaced apart parallel conductive traces deposited on substrate 34 by known techniques and which extend in an x-coordinate direction. Column busbars 41 are similar conductive traces deposited on the second dielectric layer 39 which extend in the y-coordinate direction in orthogonal relationship with the row busbars 36. The crossed row busbars 36 and column busbars 41 define an array of image pixels at which phosphor layer 38 emits light in response to application of a voltage difference across the row busbar and column busbar that cross each other at the particular pixel location. Thus any desired visible image can be generated by applying a voltage difference across each row busbar 36 and column busbar 41 that define a pixel of the image at which light needs to be emitted to form the image.

The display 17 differs from the traditional flat panel display of this type in that the optically active phosphor layer 38 and the layers of busbars 36 and 41 extend substantially to the edges of the display in order to provide a maximized image display area that is effectively coextensive with the face 22 of the display. This requires that the display 17 have a specialized construction at least at its edge regions.

An edge seal 43 extends between dielectric layers 37 and 39 around the periphery of the phosphor layer 38 to protect the phosphor from moisture and other external contaminants. In the present invention, the edge seal 43 is extremely thin so that it will not create any noticeable bezel region around the periphery of the image displaying area. The edge seal may, for example, have a thickness of about 0.01 inch. In the absence of further arrangements an edge seal this thin may not remain effective for the full life of other components of the display 17. The display 17 is made more durable by the adjacent skirt region 23 of the previously described key cap 21 which is bonded to the sides of the display 17 by bonding material 44. The bonding material 44 may be organic adhesive if the key cap 21 is formed of plastic or may be solder glass if the key cap is itself glass. The key cap skirt 23 when properly bonded to the edges of the display provides additional edge sealing for phosphor layer 38 and protects the internal thin edge seal 43 from abrasion, chemical attack and other adverse environmental conditions.

Bonding material 44 may contain dye or other coloring agent if it desired that the sides of the key appear opaque.

For clarity of illustration certain components of the display 17 are shown in the drawings with greater thicknesses, greater spacing and/or as being fewer in number than is actually the case in a typical switch key embodying the invention. Such components and spacings may be too minute to be depicted actual size in drawings having the scale of the accompanying drawings. For example, the busbar 36 and 41 layers, dielectric layers 37, 39 and phosphor layer 38 are typically extremely thin films which may be formed by photolithic techniques and deposition techniques known to the art. The thickness of the bonding material 44 may be of the order of 0.001 to 0.005 inch. The skirt 23 of key cap 21 may be thinner than is depicted in the drawings, such as where the key must fit closely with other keys as in a computer keyboard, while still remaining effective for its purpose. Busbars 36 and 41 are typically more minute, greater in number and more closely spaced than can be depicted in FIGS. 4 and 5. In order to provide images which exhibit desirably high resolution, there may for example be 80 to 300 busbars per inch in the busbar layers. Thus in a switch key that measures one half inch by one half inch there may be 40 to 150 busbars in each layer of busbars.

Thus the end surfaces of the busbars 36 and 41 are minute and may not have sufficient area to provide for reliable electrical connection of the busbars to their driver circuit IC chips which as previously described are situated at the back of substrate 34. A first set of busbar extensions 46 assure that reliable electrical connections are made to the row busbars 36. Each such busbar extension 46 is situated at the location of an end of a separate one of the row busbars 36 and has an angled first end which overlaps an end segment of the adjacent busbar 36 and which is bonded to the busbar end segment. The opposite ends of the extensions 46 are also angled and wrap around the back edges of substrate 34 and extend onto an adjacent portion of the back surface of the substrate.

Preferably the busbar extensions 46 are situated at each of the two opposite sides of the substrate 34 at which row busbar 36 ends are located. The extensions 46 at one of the opposite sides of the substrate 34 connect with alternate ones of the row busbars 36. The extensions 46 at the other of the opposite sides of the substrate connect with the others of the row busbars. This interdigitation of busbar connections simplifies fabrication of the display 17 by avoiding the need to crowd all of the extensions 46 along a single side of the substrate 34. For example, in an 0.5 inch square display with interdigitated busbars at both busbar layers, there will be 20 busbar extensions at each edge of the display if the display is to provide 80 lines per inch resolution.

Additional busbar extensions 47 are situated at the the other two opposite sides of substrate 34 and serve to electrically connect the column busbars 41 with the driver circuitry. Busbar extensions 47 may be similar to the extensions 46 except that extensions 47 are longer than extensions 46 as the column busbars 41 are further away from the substrate 34 than the row busbars 36.

Figure 6:
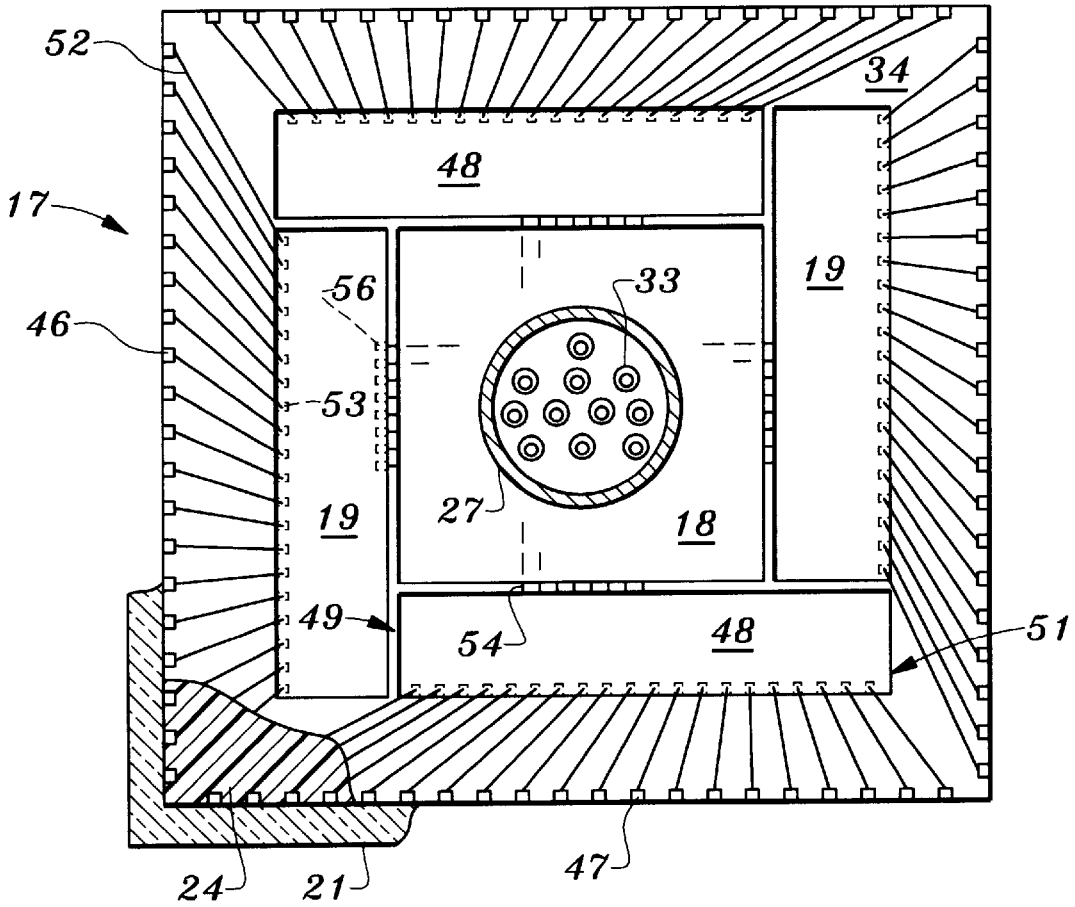
FIG. 6 is a view of the underside of the key of the preceding figures taken along line 6—6 of FIG. 1.

Referring now to FIG. 6, the driver circuitry for applying voltage to the busbars 36, 41 is embodied in a pair of column driver IC chips 48 and a pair of row driver IC chips 19 which are bonded to the back of substrate 34 in parallel relationship with the substrate. The IC chips 19 and 48 are arranged in a configuration which enables a fan out type of interconnection of the IC chips and the busbar extensions 46, 47 on the back surface of substrate 34. The IC chip arrangement is particularly appropriate for displays 17 which have sides measuring less than one inch which displays provide only a very limited area for making such interconnections.

The two row driver IC chips 19 are situated at opposite sides of PC board 18 in parallel relationship with the adjacent sides of the board. The two column driver IC chips 48 are adjacent to the other two opposite sides of PC board 18 and extend at right angles to row driver IC chips 19. As the IC chips 19, 48 are longer than the sides of PC board 18, each IC chip has a first end 49 that is flush with one side of the board and an opposite end 51 that extends beyond the board and along the first end of another of the IC chips. Conductive traces 52 on the back surface of substrate 34 fan out from solder bump connections at the output pads 53 of each IC chip 19, 48 and extend to the busbar extensions 46 or 47 which are at the same side of the display 17 as the IC chip. Additional conductive traces 54 on the back surface of substrate 34 connect the IC chip control signal terminals 56 with the previously described solder pads 33 of PC board 18.

The flat panel display driver IC chips 19, 48 may be of conventional design embodying known driver circuits and therefore will not be further described.

Figure 7:
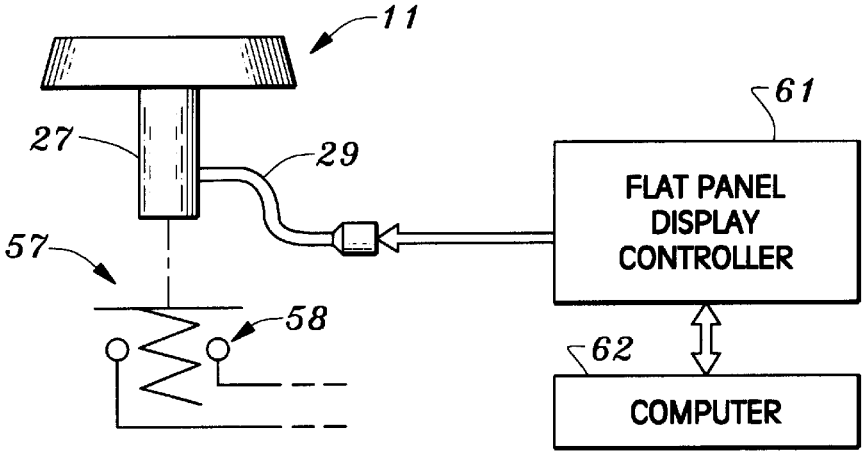
FIG. 7 is a front view of the key of the preceding figures shown in association with other components of a switch.

Referring to FIG. 7, a key 11 embodying the invention may be used with a switch 57 of any of the diverse types in which switch contacts 58 are opened or closed by manual depression of a key. A flat panel display controller 61, which may be of conventional design, is connected to the flat panel display of key 11 through the previously described multi-conductor electrical cord 29. In this particular example in which the key 11 is a component of a computer 62 alphanumeric keyboard, the computer selects the image that is to be displayed at key 11 at any given time and changes the image when the function of the key changes.

Figure 8:
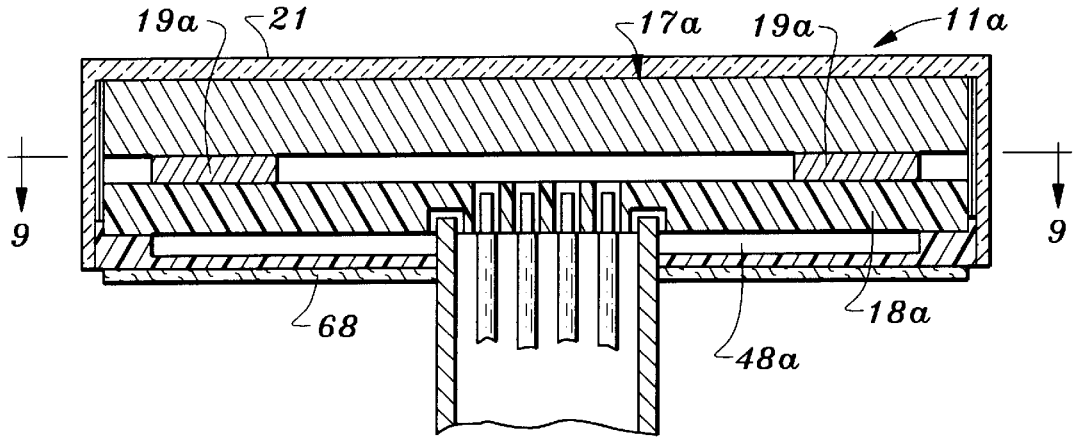
FIG. 8 is a cross section view of another switch key in accordance with a second embodiment of the invention.
Figure 9:
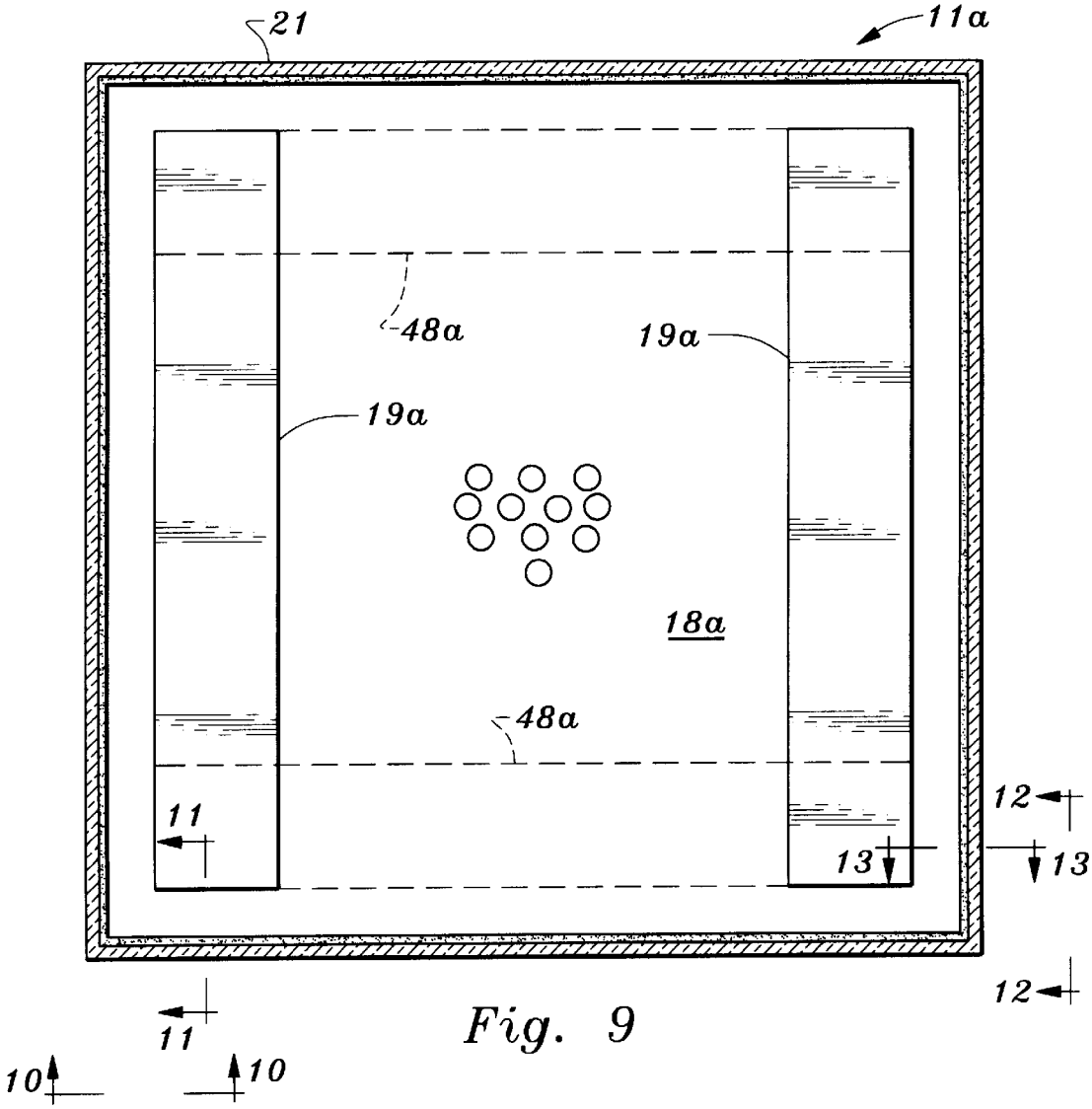
FIG. 9 is a plan section view of the key of FIG. 8 taken along line 9—9 thereof.

Referring jointly to FIGS. 8 and 9, longer driver IC chips 19*a* and 48*a* can be accommodated within the key cap 21 if the PC board 18*a* is enlarged to have an area similar to the area of the overlaying layers of the flat flat panel display 17*a*. One pair of the driver circuit IC chips, such as the row driver chips 19*a,* may then extend in parallel relationship at opposite sides of the upper surface of the board 18*a*. The other pair of IC chips, such as the column driver chips 48*a,* extend in orthogonal relationship with the row driver chips at opposite sides of the back surface of the board 18*a*. This requires changes in the components which interconnect the IC chips and the busbars.

Figure 11:
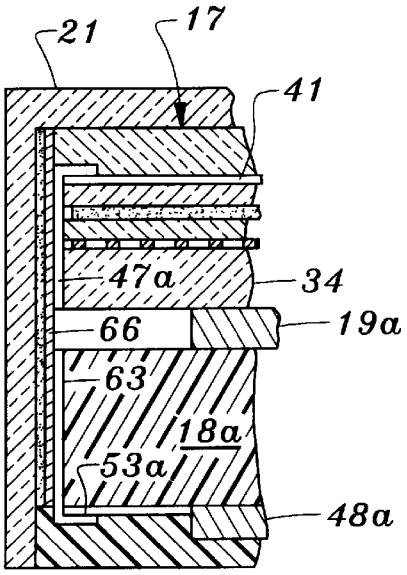
FIG. 11 is a cross section view of the first corner region of the key of FIG. 9 taken along line 11—11 thereof.
Figure 10:
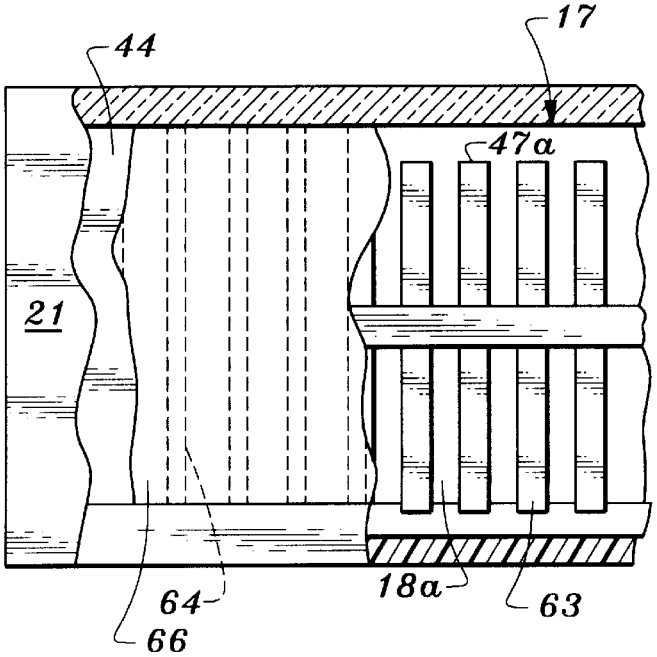
FIG. 10 is an enlarged and broken out side view of a first corner region of the key of FIG. 9 taken along line 10—10 thereof.

Referring jointly to FIGS. 10 and 11, the busbar extensions 47*a* which connect with the column busbars 41 need not wrap around onto the back surface of substrate 34 as in the previously described embodiment. Additional wrap around connectors 63 are disposed at opposite sides of circuit board 18*a* with each such connector being in alignment with a separate one of the busbar extensions 47*a*. Connectors 63 have angled ends which overlap the conductive traces 53*a* that fan out from column driver IC chips 48*a* on the back surface of board 18*a* and which contact the traces.

Each wrap around connector 63 is electrically connected with the busbar extension 47*a* with which it is aligned by one of a series of spaced apart thin film conductors 64 which extend along both of the connector and the busbar extension in contact with each. The thin film conductors 64 are preferably conductive traces on a backing strip 66 of flexible insulative material which is bonded to the adjacent edges of the display 17. Using screen printing or photolithic techniques, flexible connector strips of this kind can be fabricated to have a thickness that ranges down to about 0.001 inch.

Figure 13:
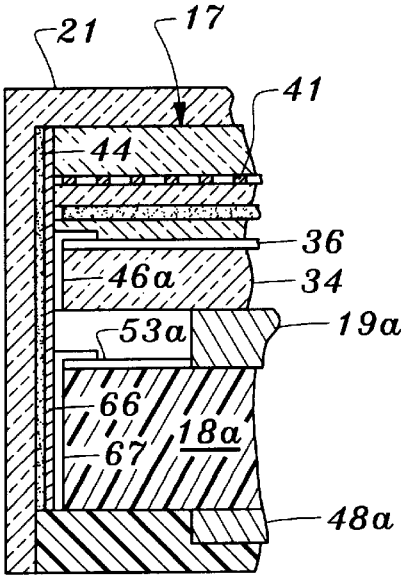
FIG. 13 is a cross section view of the second corner region of the key of FIG. 9 taken along line 13—13 thereof.
Figure 12:
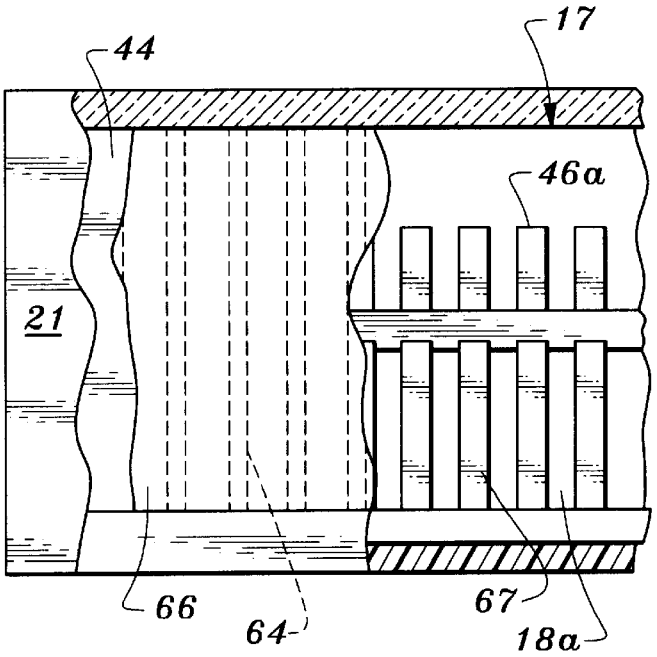
FIG. 12 is an enlarged and broken out side view of a second corner region of the key of FIG. 9 taken along line 12—12 thereof.

Referring jointly to FIGS. 12 and 13, the other busbar extensions 46*a* which connect with the ends of the row busbars 36 also need not be angled to overlap the back surface of substrate 34 as in the previously described embodiment. Additional wrap around connectors 67 are bonded to opposite sides of circuit board 18*a* with each being in alignment with a separate one of the row busbar extensions 46*a*. The connectors 67 have angled ends that overlap the conductive traces 53*a* that fan out from the row driver IC chip 19*a* on the front surface of board 18*a*. Additional thin film conductors 64 on flexible insulative backing strips 66 of the previously described kind extend along row busbar extensions 46*a* and connectors 67 in electrical contact with each to complete the interconnection of the row busbars 36 and row busbar driver IC chips 48*a*.

Other components of the embodiment of FIGS. 8 to 13 may be similar to the corresponding components of the embodiment of FIGS. 1 to 7.

Referring again to FIG. 8, a layer 68 of resilient material such as neoprene or foam rubber may be bonded to the underside of the key 11*a* to cushion the key in instances where it may contact the underlying switch housing as it is depressed.

The previously described examples of the invention have flat panel displays of the electroluminescent type in which a phosphor layer emits light to form an image. In other forms of flat panel display, such as a liquid crystal display for example, the optically active layer does not itself generate light. Rather, the optically active layer modulates light that is produced by a light source in the display. A key construction generally similar to that described above with reference to FIGS. 8 enables inclusion of the light source or reflective surface in the key.

Figure 14:
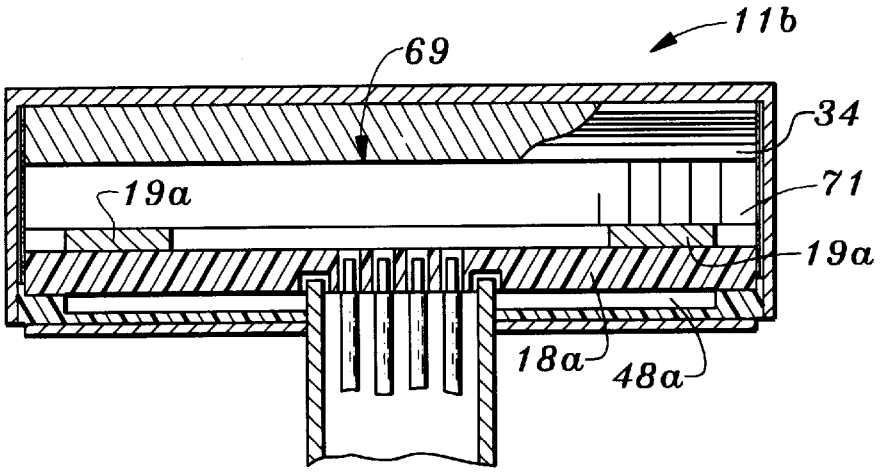
FIG. 14 is a cross section view of a switch key in accordance with a third embodiment of the invention.

For example, with reference to FIG. 14, a light generating layer 69 may be disposed between substrate 34 and the row driver IC chips 19*a* on PC board 18*a*. Layer 69 is an array of light emitting diodes 71 in this example but other types of light source known to the art may also be used. The key 11*b* of FIG. 14 may otherwise be similar to the key previously described with reference to FIGS. 8 to 13.

In flat panel displays of the active matrix type, both the row busbars and the column busbars may be situated at the same side of the optically active layers. The busbar extensions and wrap around connectors described above may also be used in displays of this type to interconnect the busbars and driver IC chips. The hereinbefore described transparent switch cap can advantageously be used with any of the different kinds of displays for the purpose of enhancing edge sealing of the optically active layer.

Figure 15:
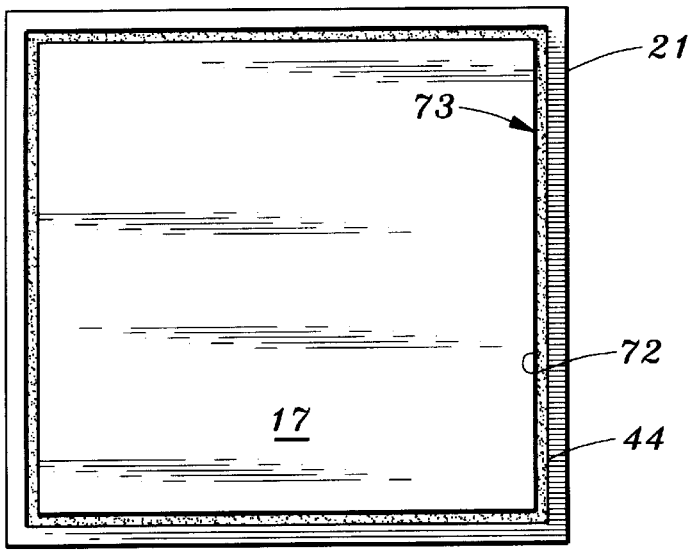
FIG. 15 is a diagrammatic view of the underside of a switch key of the general type depicted in the preceding figures.
Figure 16:
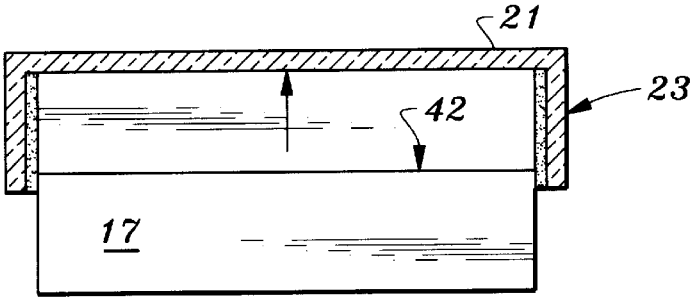
FIG. 16 is a diagrammatic cross section view of the key of FIG. 15 illustrating a step in the fabrication thereof.

Referring jointly to FIGS. 15 and 16, the transparent key cap 21 of any of the previously described embodiments of the invention has a recess 72 for receiving the flat panel display 17. The recess 72 is slightly larger than the display 17 to provide a gap 73 between the sides of the cap and the display in which the bonding material 44 is situated. The gap 73 may, for example, be about one to five mils wide. A layer of the bonding material 44 is applied to the inside surface of the skirt region 23 of key cap 21 prior to insertion of the display 17. The bonding material may be an organic adhesive if the cap is formed of transparent plastic. Adhesive may also be used with a glass cap 21 but in this case it is preferable that the bonding material be solder glass. After insertion of the display 17 into recess 72, the solder glass may be heated to cause it to bond to the adjacent edge of display 17. Heating is preferably done by focusing a laser beam at the solder glass through the skirt region 23 of cap 21 as this minimizes heating of the cap and display 17. The solder glass should have a lower melting point than the materials of the display 17 and cap 21. Formulating the solder glass to have a dark color increases heat absorbency and further concentrates heating at the solder glass. The solder glass and the glass of cap 21 and the substrate glass within the display 17 should have similar coefficients of thermal expansion.

In displays 17 which have a polymer sealant layer 42 at the face of the display, the edges of the sealant layer can be spaced back a few mils from the edges of the other layers of the display. This avoids damaging of the heat sensitive polymer if the solder glass is heated very quickly with a focused laser beam.

Figure 17:
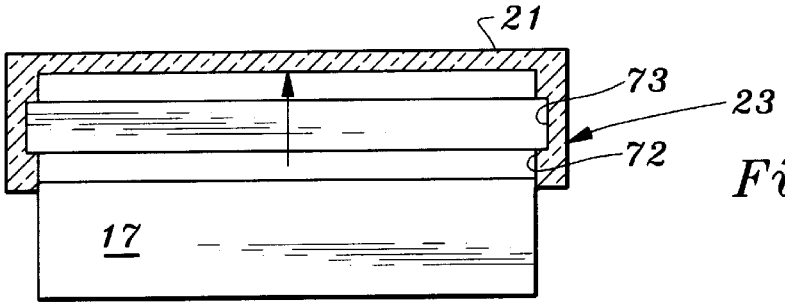
FIG. 17 is a diagrammatic cross section view illustrating a first modification of the key of FIGS. 15 and 16.
Figure 18:
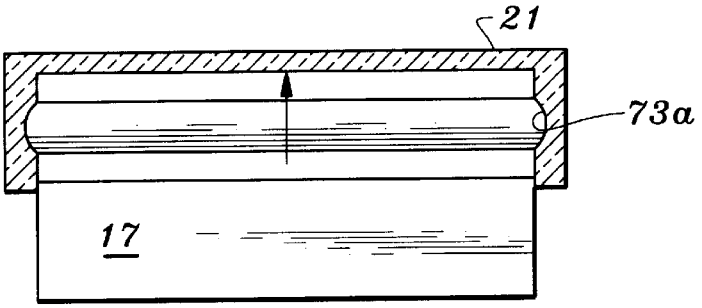
FIG. 18 is a diagrammatic cross section view illustrating a second modification of the key of FIGS. 15 and 16.

Referring to FIG. 17, recess 72 of key cap 21 may include a groove 73 which extends around the inside surface of the skirt 23 of the key cap and adhesive or solder glass 44 may be disposed within the groove. The groove 73 has a rectangular profile as depicted in FIG. 17 which configuration is suitable for a plastic cap 21. A rounded groove 73*a* as depicted in FIG. 18 is easier to form in a glass cap 21.

Figure 19:
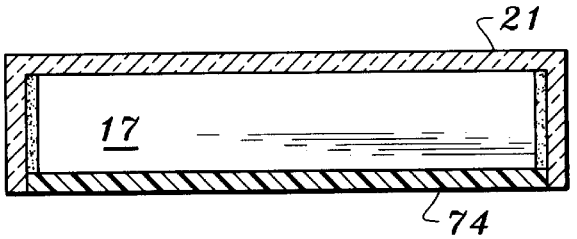
FIG. 19 is a diagrammatic cross section view illustrating a third modification of the key of FIGS. 15 and 16.

Referring to FIG. 19, moisture sealing of the display 17 can be further enhanced by providing a layer 74 of adhesive or solder glass at the back of the display.

Figure 20:
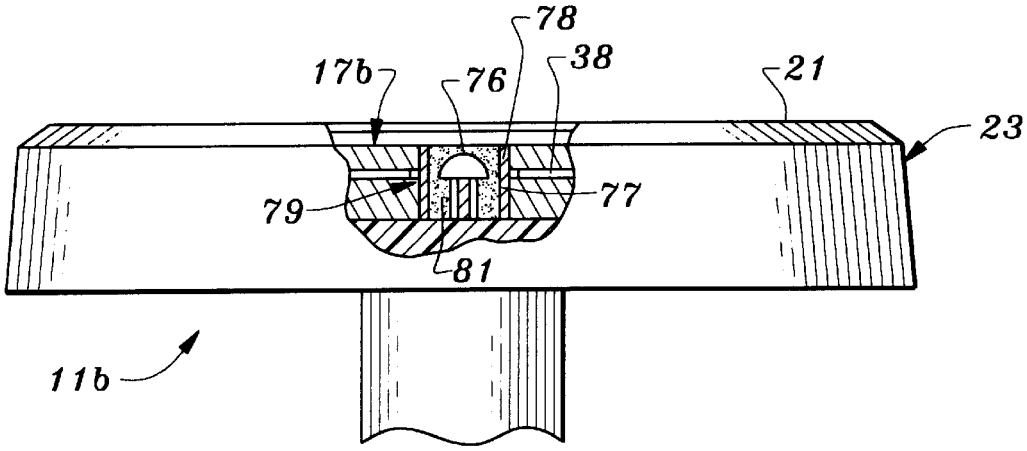
FIG. 20 is a broken out side view of a switch key having a flat panel display therein for displaying changeable labels and having and having an additional light emitting component in the image area of the display.

Referring to FIG. 20, it can be advantageous in some usages of switch keys 11*b* which have internal flat panel displays 17*b* to provide an indicator light, such as a light emitting diode 76, at the face of the display. The light may, for example, indicate when the key has been operated and the function which it initiates is in progress. An indicator light can present color in what is otherwise a monochrome image display.

Disposition of the diode 76 within the image displaying area of the display 17 requires that there be a passage 77 which extends through the display 17. A plug or tubular sleeve 78 of glass or plastic may be used to supplement a thin edge seal 79 of the previously described kind at the location where the optically active layer 38 of the display is intersected by the passage 77. The plug or sleeve 78 is bonded to the display 17 with solder glass or adhesive in the manner previously described with reference to sealing of the periphery of the display. Diode 76 may be embedded in transparent plastic 81 within the plug or sleeve.

Figure 21:
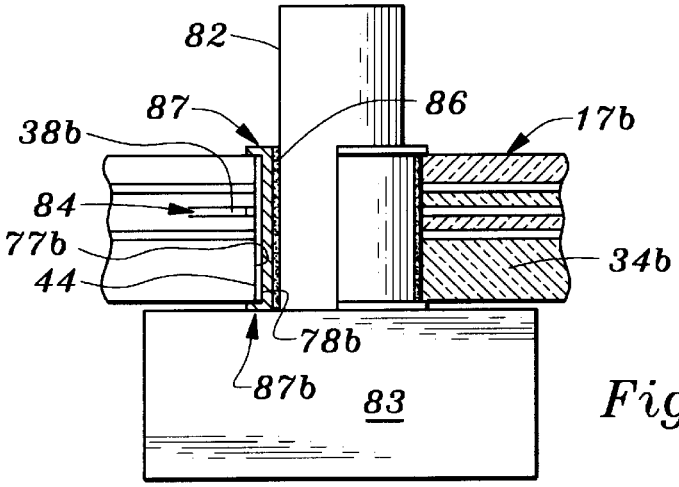
FIG. 21 is a cross section view of a portion of a flat panel display having a switch actuator button extending through the image area of the display.

Plugs or sleeves of this kind may be used to provide enhanced edge sealing at passages in flat panel displays that are not a component of a switch cap. Referring to FIG. 21, for example, a passage 77*b* may extend through the image area of a flat panel display 17*b* to enable a movable control member 82 to extend through the display. The control member 82 in this example is a switch button which protrudes from a switch housing 83 situated behind the display 17. In this arrangement, the switch button 82 itself need not have an embedded display. Changeable images pertaining to the function or functions initiated by the button are presented by the display 17 at a location that is adjacent to the switch button.

The internal edge seal 84 of this embodiment is a thin ring of epoxy or the like situated adjacent to passage 77*b* at the optically active layer 38*b* of the display. Sleeve 78*b* is bonded to the display 17*b* including at edge seal 84 by bonding material 44 of the previously described kind. Where a movable component such as switch button 82 extends through the passage 77*b,* sleeve 78*b* may have a tubular inner liner 86 formed of Teflon or other material having a low coefficient of friction in order to prevent abrasion of the sleeve. The sleeve 78*b* may also have a small flange 87 which overlaps the face of display 17 in order to protect the edge formed by the intersection of passage 77*b* with the face of the display and may have a similar flange 87*b* at the opposite end of the sleeve which overlaps the back surface of substrate 34*b*.

Figure 22:
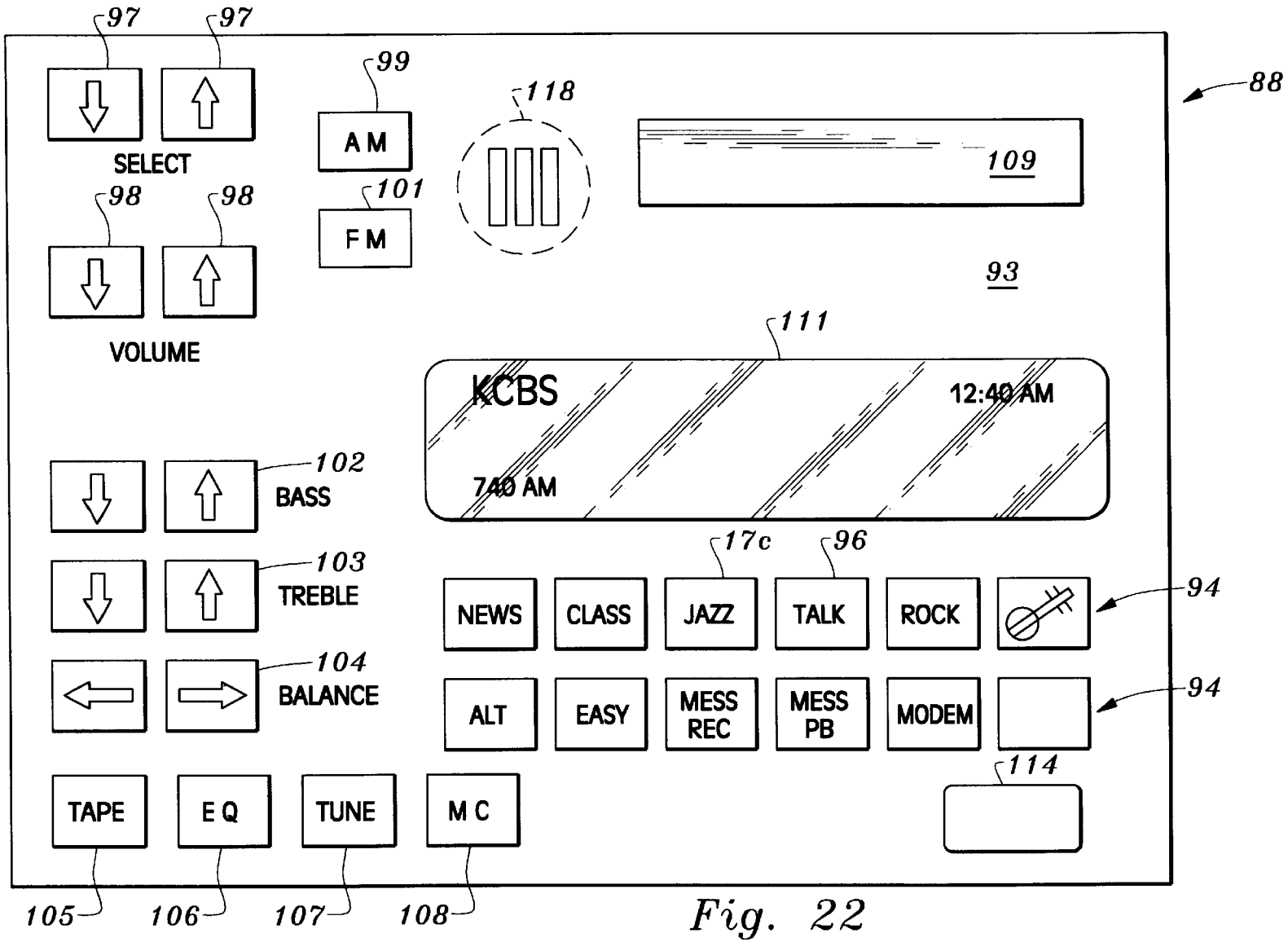
FIG. 22 is a front view of an operator/circuit interface which may be used to control a plurality of different electronic devices with a single set of switches and which uses flat panel displays as switch buttons in order to change the labeling of the switch buttons during the different modes of operation.

The capability of instantly and automatically changing the labeling of a switch key or switch button makes it possible to use a single set of manual controls for controlling a plurality of different electronic devices that may have diverse different functions. This can simplify operation of plural electronic systems in homes, offices, vehicles and elsewhere. For purposes of example, FIG. 22 depicts a universal operator/circuit interface 88 which is designed to control electronic accessories which are present in an automobile.

Figure 23:
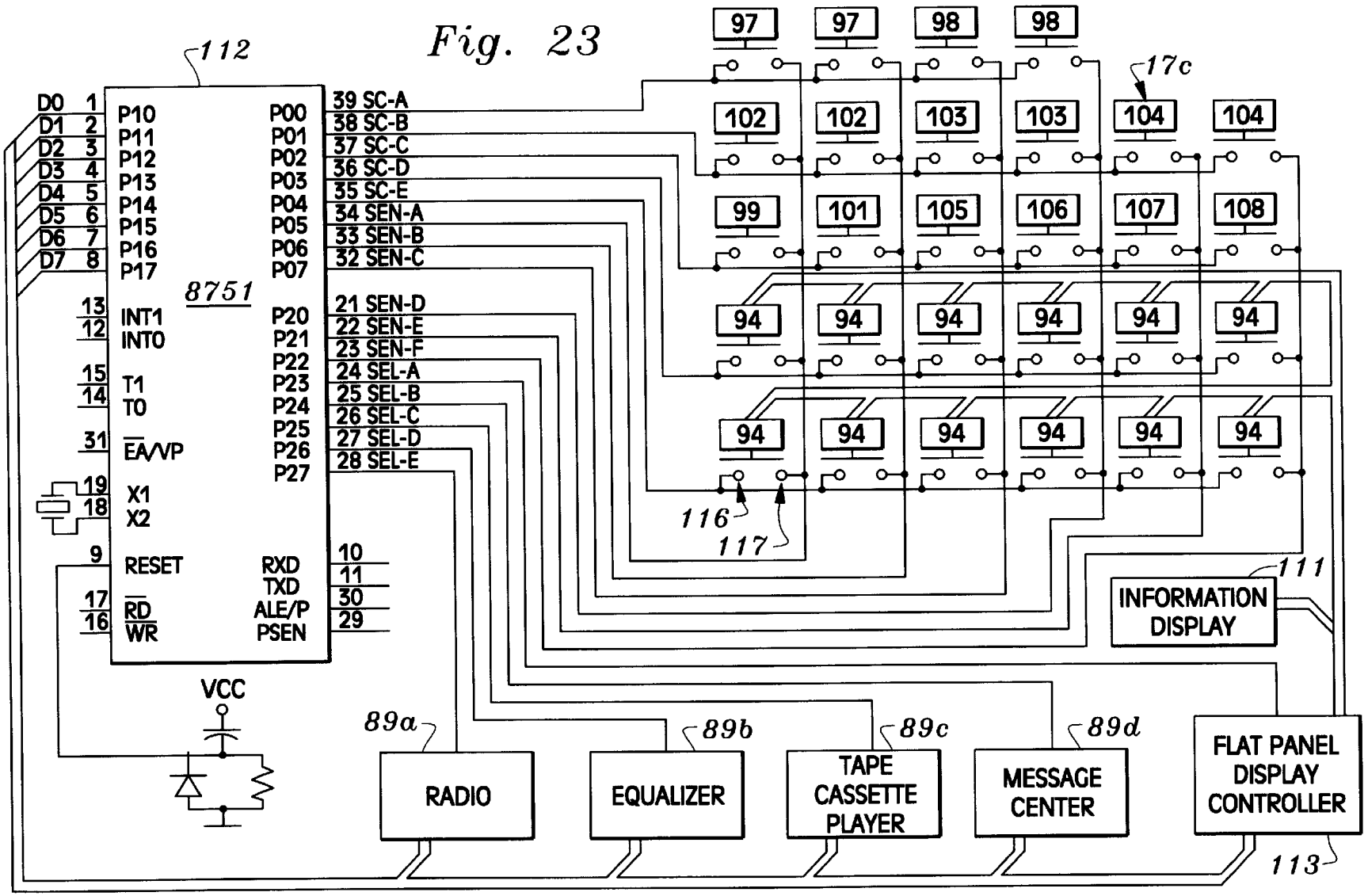
FIG. 23 is a schematic circuit diagram depicting the electrical circuit of the operator/circuit interface of FIG. 22.

Referring to FIG. 23, the controlled devices in this particular instance are a radio 89*a,* an audio frequency equalizer 89*b,* a tape cassette player/recorder 89*c* and a telephone interface and message center 89*d* of the type which can be connected to a notebook computer through a modem to enable entry, storage and display of written messages. The internal circuits and mechanisms of the controlled devices may be of the known designs. These are merely representative of the types of electronic devices that can be controlled through the universal interface 88 as a variety of other electronic systems that respond to electrical control signals can also be operated with an interface 88 of this kind.

Referring again to FIG. 22, the interface 88 of this example has a control panel 93 with twelve push button switches 94 which may be similar to the previously described switches. Thus each switch 94 has a switch button 96 with a flat panel display 17*c* at its face in order to display different labels or symbols during different modes of operation. The control panel 93 carries additional controls which perform only one function and which may have permanent labels rather than flat panel displays. In this example these additional controls include a pair of selector switches 97, a pair volume control switches 98, switches 99 and 101 for selecting either AM or FM in the radio mode of operation, pairs of switches 102, 103 and 104 for adjusting bass, treble and balance respectively during audio modes of operation and four system selector switches 105, 106, 107 and 108 which in this example are used to initiate the radio, the equalizer, the tape cassette and the message center modes modes of operation respectively. Additional mode selector switches or dual mode selector switches can be provided if additional electronic devices are to be controlled.

The control panel 93 of this example is further provided with a tape cassette drawer 109 and a flat panel information display screen 111. The tape cassette player may be of either the digital or analog form.

Referring again to FIG. 23, the above described switches 96, 97, 98, 99, 101, 102, 103, 104, 105, 106, 107 and 108 are each electrically connected to a microprocessor 112 which is programmed as hereinafter described to transmit the appropriate control signals to the controlled devices 89*a,* 89*b,* 89*c* and 89*d* in response to operation of the switches. The images which are displayed at the switch buttons 96 and at the information display 111 are controlled by the microprocessor 112 through a flat panel display controller 113 which may be of known design. The microprocessor 112 of this example is of a type having internal read only memory of the user programmable (EPROM) type in which the image data is stored. An external memory chip may be used for the purpose if the microprocessor is not of this type. Referring again to FIG. 22, the interface 88 may be provided with an ethernet port 114 into which a laptop computer may be plugged thereby enabling entry of image data generated at the computer.

Each of the push button switches 96 to 99 and 101 to 108 includes a first switch contact 116 and a second contact 117 which contacts are in a normally open condition and which close when the associated switch button is depressed. The pairs of switch contacts 116, 117 are divided into groups wherein the first contacts 116 of the members of each group are connected to a different one of a series of scan signal ports SC-A, SC-B, SC-C, SC-D and SC-E of microprocessor 112. The second contacts 117 of each pair of switch contacts are each connected to a different one of a series of sense signal ports, SEN-A to SEN-F, of the microprocessor 112. Each second contact 117 is connected to a particular one of the sense signal ports SEN-A to SEN-F that is not connected to any other second contact in the group of contacts 116, 117 to which the second contact 117 belongs. Microprocessor 112 sequentially switches the voltage at the scan signal ports between high and low states and monitors the condition of the sense signal ports in order to detect closure of the any of the switch contacts 116, 117 and to identify the particular pair of contacts. The microprocessor 112 activates a selected one of the controlled systems 89*a* to 89*d,* in response to actuation of a system selector switch 102 to 104, through a series of select ports SEL-A to SEL-E each of which is connected to a separate one of the systems and one of which is connected to the flat panel display controller 113.

The microprocessor 112 of this particular example of the invention is of the INTEL 8751 type and pin connections between the microprocessor and other components of the invention are shown that are appropriate for that particular microprocessor.

The radio mode of operation is selected by depressing tune switch 108. Microprocessor 112 responds by causing the switch buttons 96 to display the call letters of the stations which each button selects. In response to operation of a particular switch button 96, the microprocessor causes the call letters of the selected station, along with the station frequency and the time of day, to be displayed at the information display 111.

Figure 24:
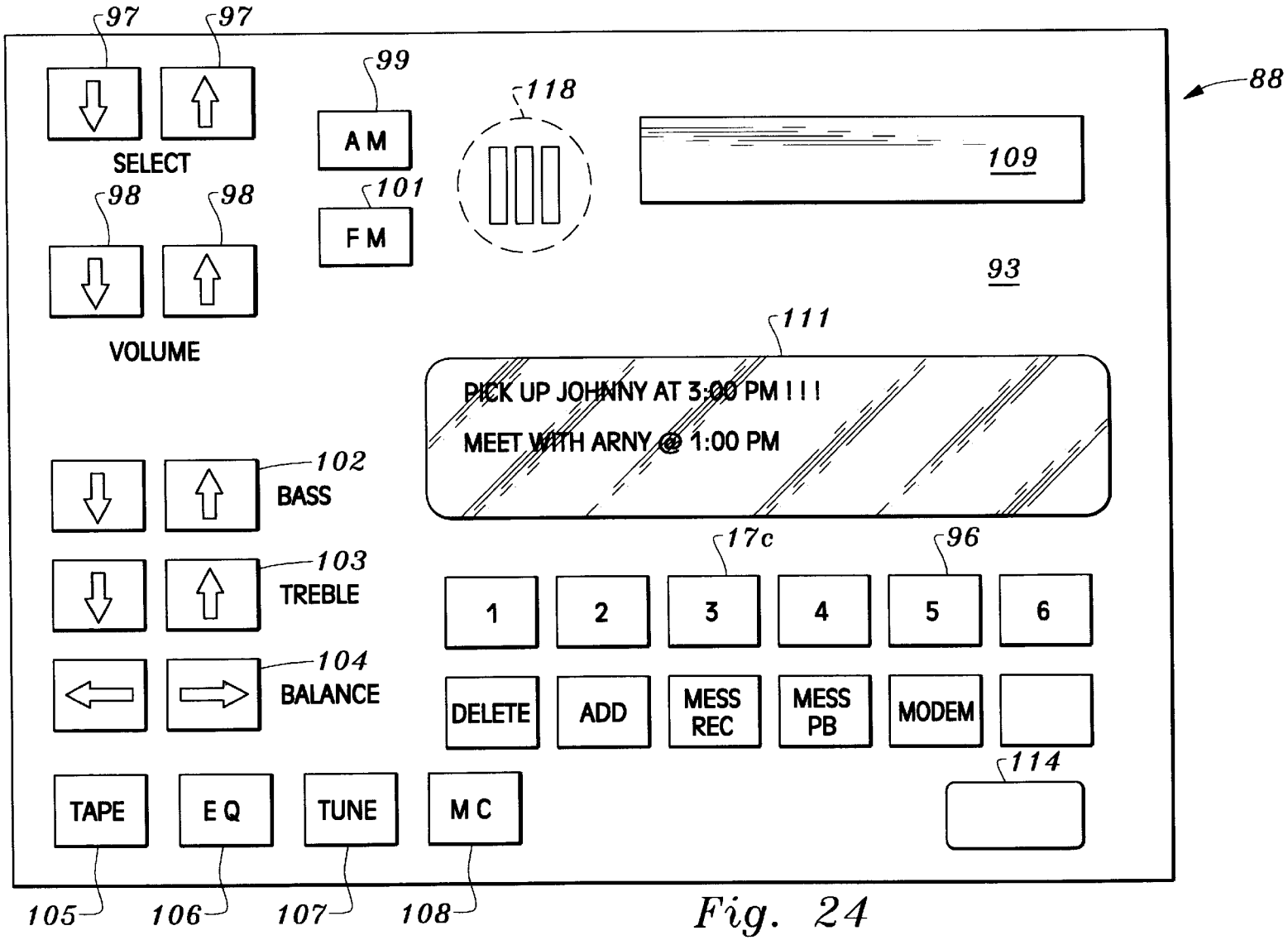
FIG. 24 is a front view of the operator/circuit interface of FIG. 22 during a second mode of operation.

FIG. 22 illustrates an alternate form of display for the switch buttons 96 during the radio mode of operation. In particular, radio stations are identified at the displays 17*c* of push buttons 96 by their type of programming content such as "News", "Classical" and "Jazz" and similar terms. FIG. 24 depicts different labels which are displayed in response to actuation of the message center system selector switch 108. The control panel 93 may be provided with a microphone 118 to enable recording of messages which may later be played back in response to operation of a particular switch button 96.

Figure 25:
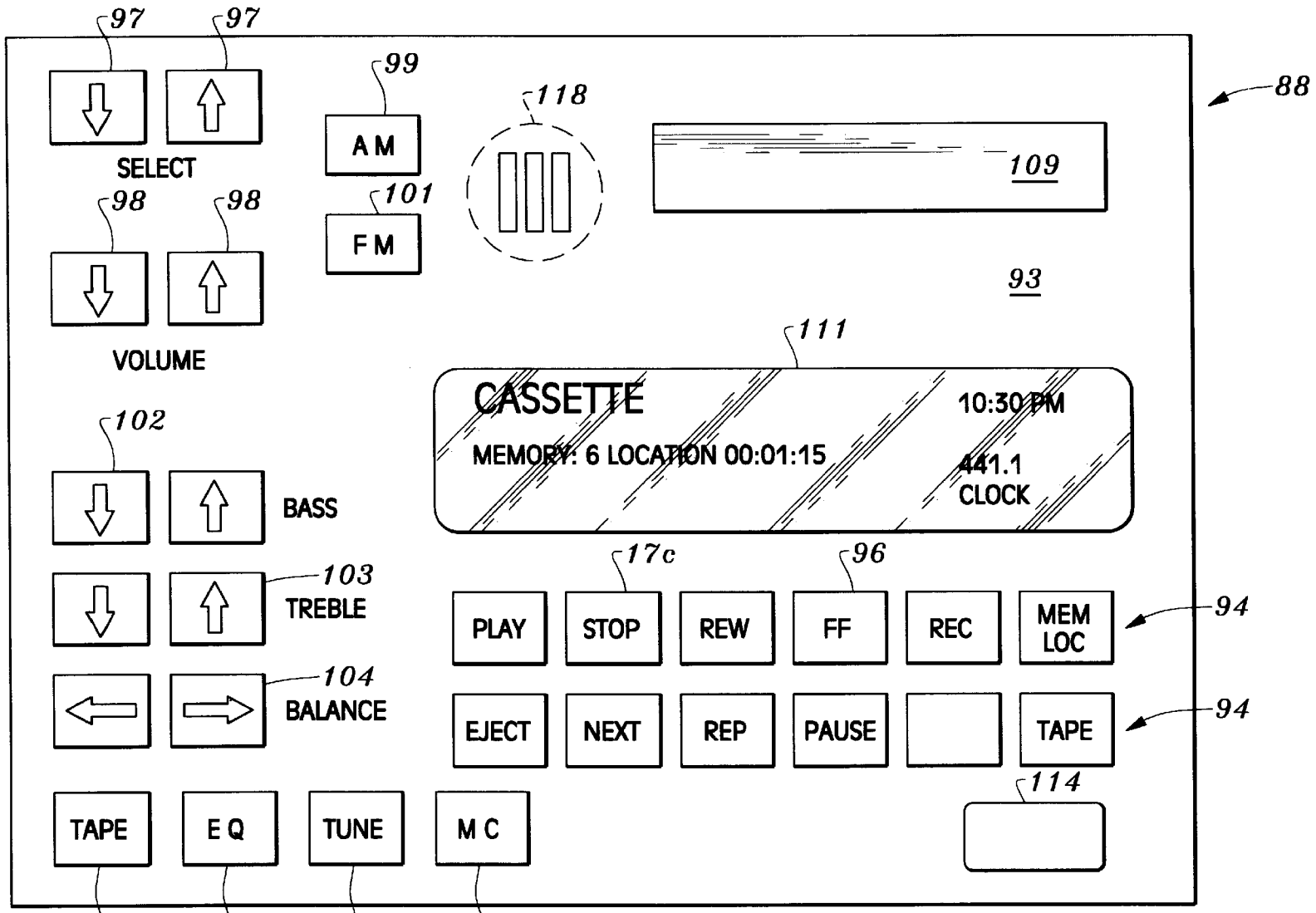
FIG. 25 is a front view of the operator/circuit interface of FIG. 22 during a third mode of operation.
Figure 26:
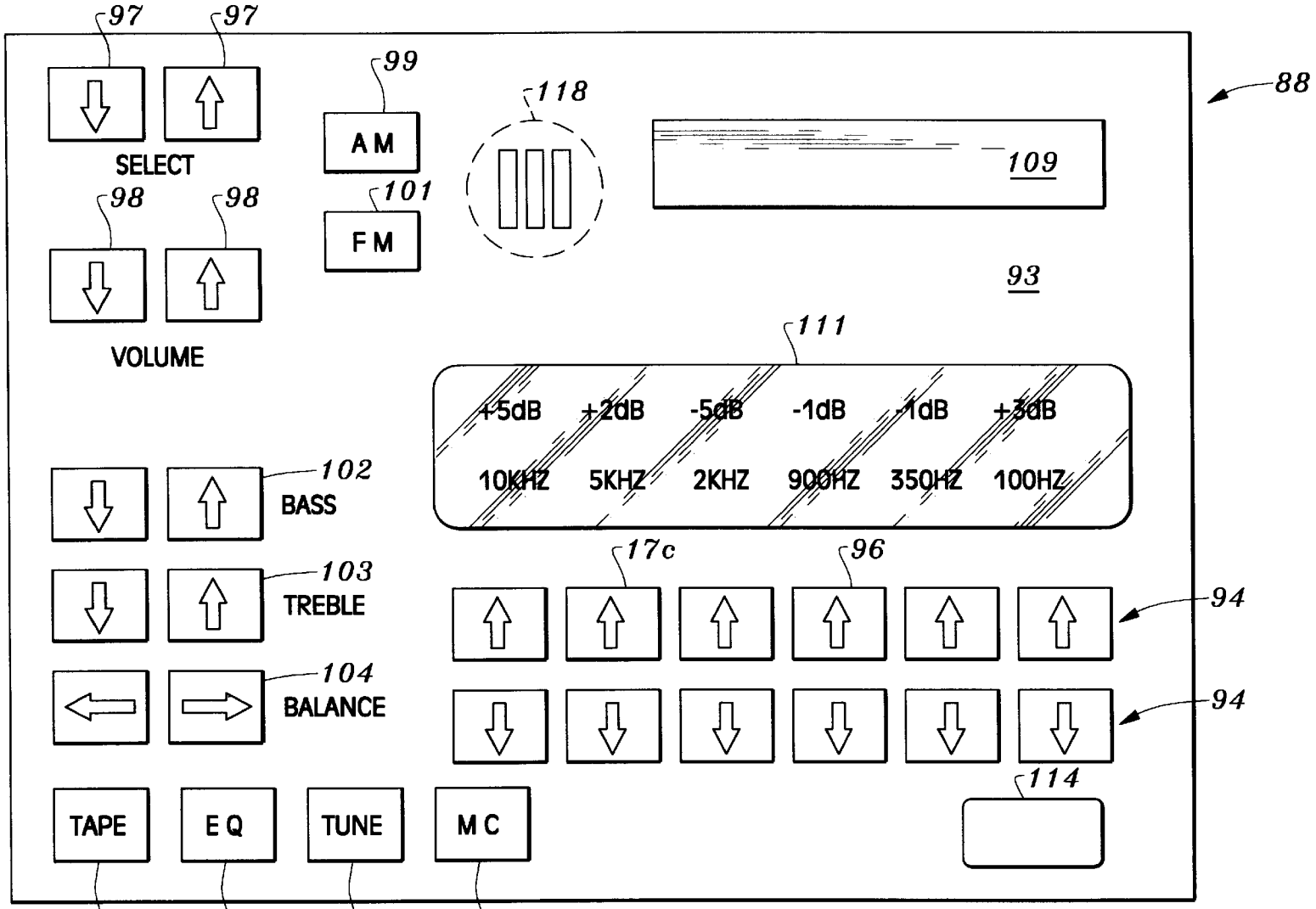
FIG. 26 is a front view of the operator/circuit interface of FIG. 22 during a fourth mode of operation.

The interface 88 controls the tape cassette player/recorder 89*c* in response to actuation of system selector switch 107. FIG. 25 illustrates changed push buttons labels and an information display at display 111 that are appropriate for the tape cassette mode of operation. FIG. 26 depicts image displays which are appropriate for the equalizer control mode of operation that is initiated by actuation of system selector switch 106.

Figure 27A:
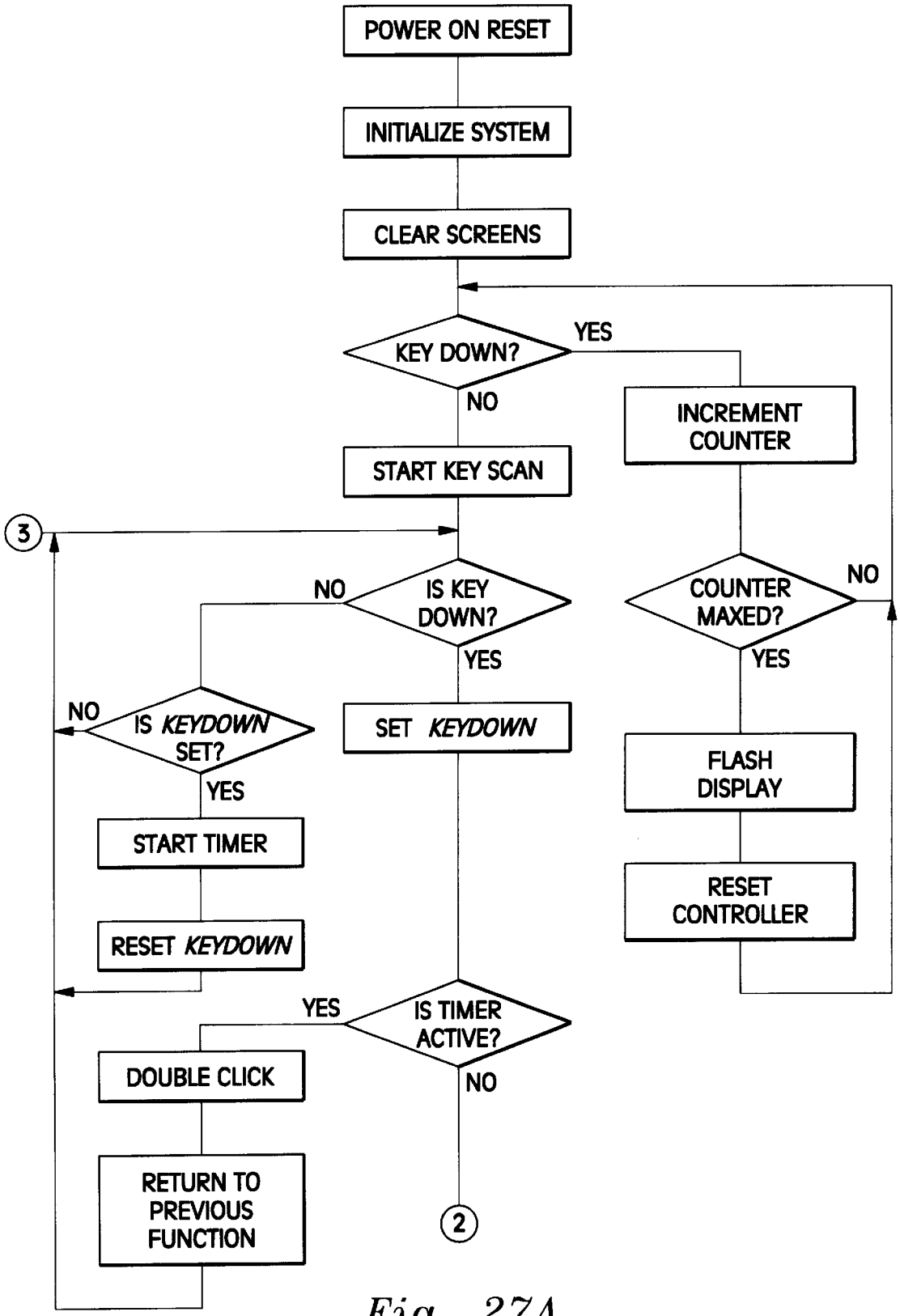
FIGS. 27A, 27B and 27C are a flowchart depiction of the programming of the microprocessor component of the circuit of FIG. 23.
Figure 27B:
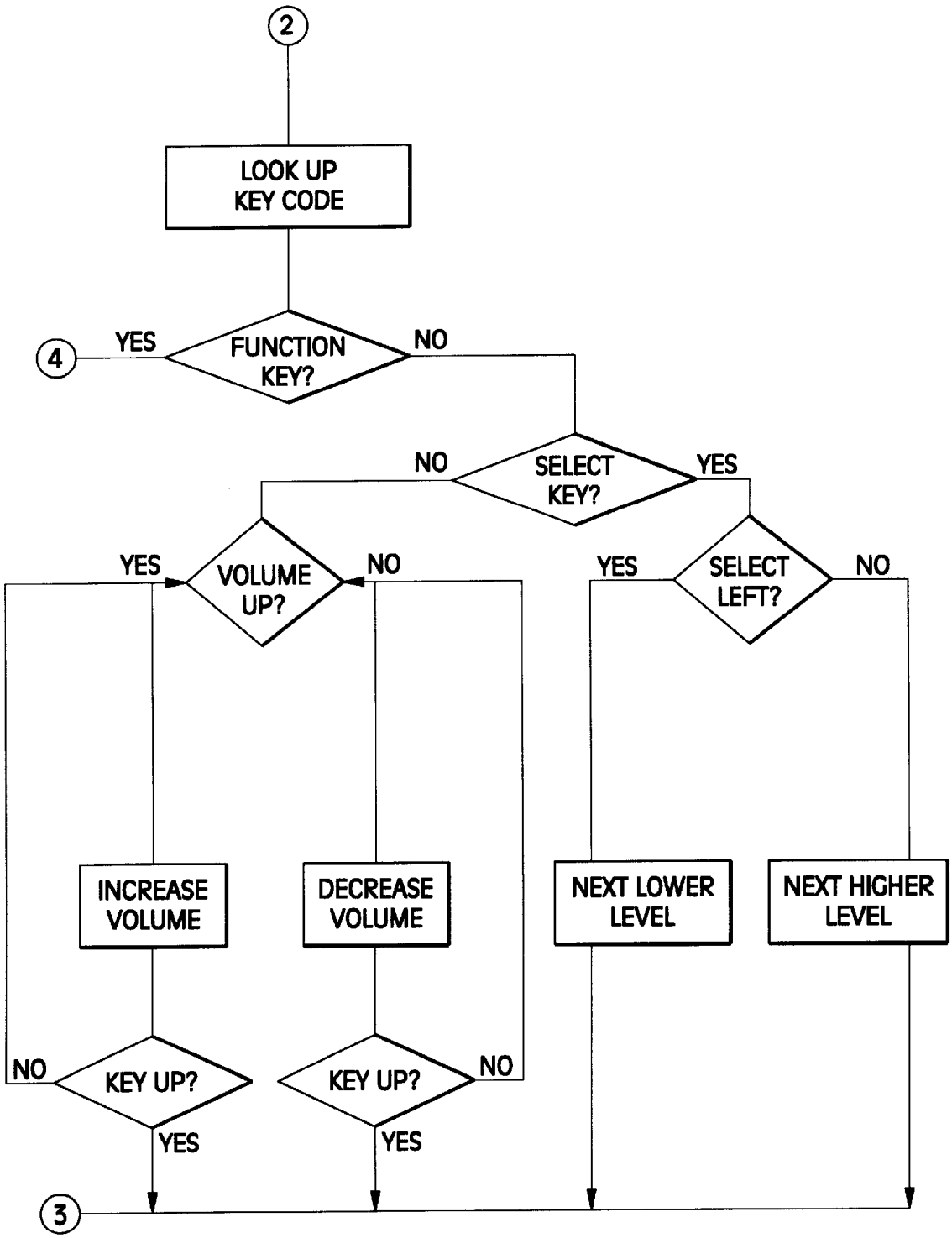
Figure 27C:
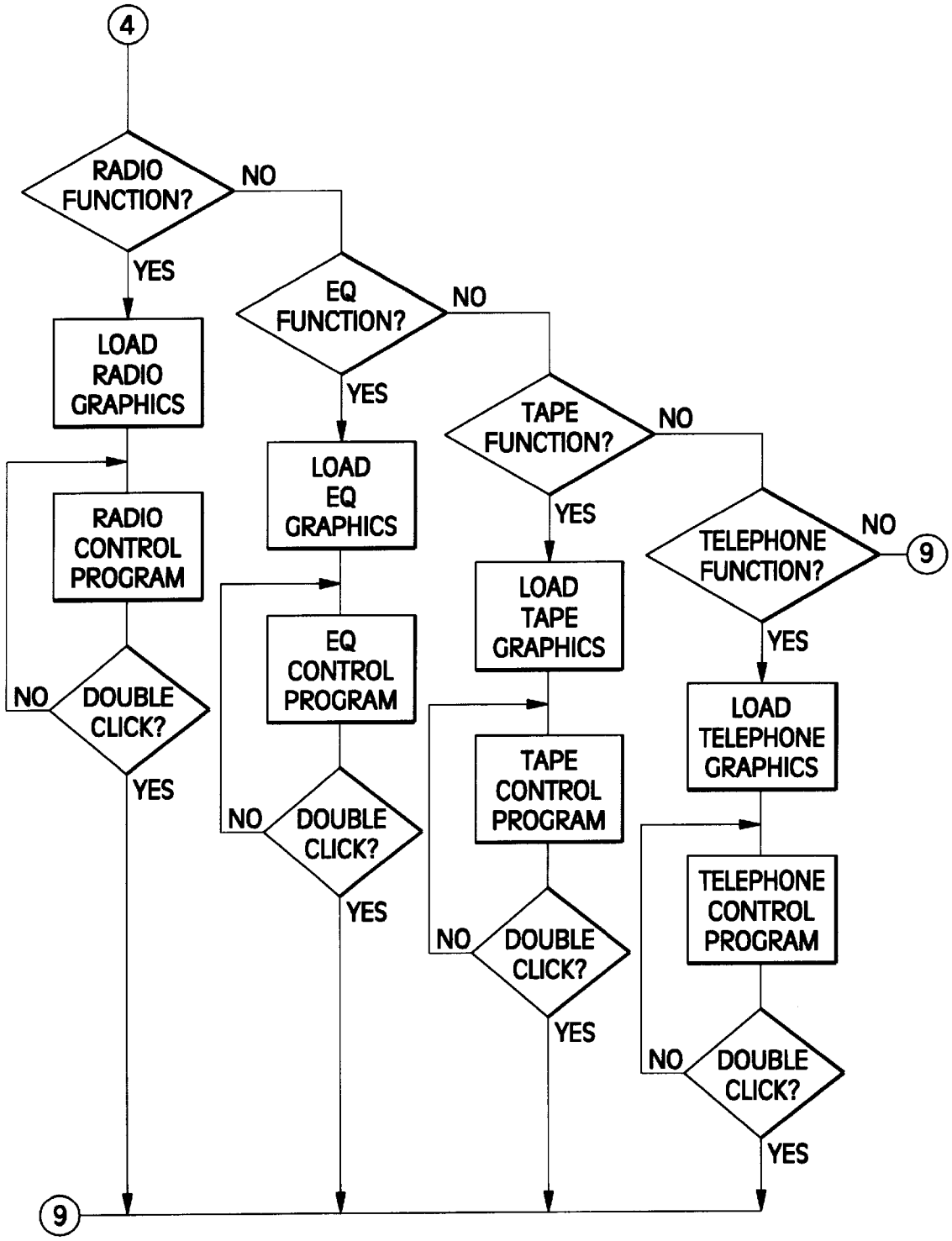

A microprocessor program suitable for implementing the above described operations is depicted in FIGS. 27A, 27B and 27C. Referring to FIG. 27A in particular, at start up the program resets the microprocessor, initializes the system including the key operated switches and clears the flat panel display screens. An initial "stuck key" scan of the key operated switches is conducted to determine if any switch key is stuck or being held in the closed position. If a closed switch is sensed a counter is incremented by a count of one and another key scan is conducted and the counter is again incremented by a count of one. Scanning and incrementing of the counter continues until either no closed switch is sensed or the accumulated count reaches a maximum which is sufficiently high to establish that the switch closure is not a momentary condition. The maximum count may, for example, correspond to one half second.

When a closed or down key is detected in this manner the microprocessor directs the display controller to generate to illuminate each of the display screens and then quickly resets the controller to extinguish the images. The program then initiates another key scan and if the down key condition is still present the process is repeated and the images flash on again. The program continues to loop in this manner, causing the displays to flash on and off repetitively, until the down key condition is corrected.

When the initial or a subsequent key scan indicates that no key switch is closed, the program continues to initiate repetitive key scans and responds to sensing of switch closures in a different manner. If a key closure is detected a "keydown" signal is set into a register. If no key closure is detected the program checks to see if a keydown signal is already set in the register and, if this condition exists, starts a timer which remains active for for a limited period of time such as one half second for example. The register is reset at the end of that limited period and the program returns to the stage of the program that is identified by connector 3 in FIG. 27A. The program returns immediately to the connector 3 stage if no key closure is detected during the course of a key scan and the keydown register is in a reset condition at the time.

The purpose of the timing step is to enable the operator to restore the system to a default mode of operation by double clicking of any of the active keys, i.e. by depressing the key twice in a short period of time such as one half second for example. In response to setting of a keydown signal into the previously described register, the program determines if the previously described timer is currently active. If it is, a double click has been detected and the program establishes the default mode of operation and then returns to the connector 3 stage of the program. The default in this example is a restoration of the previous mode of operation of the interface. Thus if if the operator had been playing the radio and then switched to the equalizer function to make sound adustments, a double click restores the radio mode of operation. The default may be some other action such as placing all of the controlled devices in an inactive condition for example.

If the timer is not active at the time that a keydown signal is set into the register a double click cannot be in progress and the program proceeds to the stage identified by connector 2 in FIG. 27B. At that stage the microprocessor identifies the key which initiated the keydown signal by referring to a look up table of key codes. If the identified key is not one of the system selector keys 105 to 108, the microprocessor checks to see if it is one of the select keys 97 and, if so, determines if it is the left select key. The function which is in operation is set to its next lower level if it is the left select key or is set to its next higher level if it is not the left select key. The program then returns to the connector 3 stage.

If the identified key is not a system selector key and is not a select key the program determines if it is the right or up volume key 98. In that event the program initiates an increase of sound volume which continues until a key up condition is sensed during a subsequent key scan. If it is not the right or up volume key the sound volume is progressively decreased until the key up condition is sensed. In either case the program then returns to the connector 3 stage.

If the operated key is identified as one of the system selector keys 105 to 108, the program proceeds to the stage identified by connector 4 in FIG. 27C. If the key is the radio selector key 107 the program initiates loading of the previously described radio mode graphics into the display screens of the interface and activates the radio control program. The program continues the radio mode of operation until a double click is detected in the previously described manner at which point the program returns to the stage identified by connector 9 in FIG. 27A.

Referring again to FIG. 27C, if the operated key is identified as the equalizer key 106 the previously described equalizer graphics are loaded into the display screens and the equalizer control program is activated. Operation of the interface in the equalizer mode continues until a double click causes the program to return to the connector 9 stage. If the operated key is the tape cassette player key 105 the graphics for that mode of operation of the interface are loaded into the displays and the tape control program is activated. Operation in that mode continues until detection of a double click returns the program to the connector 9 stage. Similarly, if the operated key is determined to be the telephone interface and message center key then the message center graphics are loaded into the displays and the telephone interface and message center control program is activated. Thereafter, detection of a double click returns the program to the connector 9 stage.

The control programs for the controlled devices, such as the radio for example, may be similar to known programming for devices of the type that respond to digital control signals.

The operator/circuit interface 88 of this example controls electronic devices in a vehicle. Similar interfaces can be programmed to control plural devices that are typically found at other locations. In a home, for example, the interface can be adapted to control such electronic systems as a television set, a radio, a compact disk player, a heating and air conditioning system and a a microwave oven as well as other appliances. For this usage, the interface may if desired be constructed as a hand held remote control unit.

Components which are depressed by an operator's finger in order to operate a switch or the like are referred to by various different names, such as "key" or "button" for example, depending on the type of device which the switch controls. The word "key" as used in the following claims should be understood to refer to any of these functionally similar switch actuators.

While the invention has been disclosed with respect to certain specific embodiments for purposes of example, many modifications and variations are possible and it is not intended to limit the invention except as defined in the following claims.

I claim:

1. A switch key which displays changeable images pertaining to use of the key comprising:

an electrically controlled flat panel display having front and back surfaces and having an image display area formed by an optically active layer at which images are generated and in which said optically active layer including said image display area extends substantially to at least one edge of the flat panel display, and a key cap having a transparent face overlaying said front surface of said flat panel display and having a skirt region which extends along said edge of said flat panel display and which is bonded to said edge of said flat panel display by moisture impervious bonding material which contacts said skirt region and said edge of said flat panel display, said key cap and bonding material forming a continuous unbroken seal along said edge of said flat panel display, wherein said key cap has a recess behind said face thereof which is bounded by said skirt region of said key cap, said flat panel display being disposed within said recess in parallel relationship with said face of said key cap and wherein said optically active area of said flat panel display including said image display area is substantially coextensive with said front surface of said flat panel display.

2. The apparatus of claim 1 wherein said optically active layer of said flat panel display includes a volume of optically active material bounded by a moisture impervious edge seal within said flat panel display which edge seal is adjacent to said edge of said flat panel display.

3. The apparatus of claim 1 wherein said key cap has a recess behind said face thereof which is bounded by said skirt region of said key cap, said flat panel display being disposed with said recess in parallel relationship with said face of said key cap, said recess having a depth which exceeds the thickness of said flat panel display, further including a layer of fluid impervious material disposed in said recess behind said flat panel display, said layer of fluid impervious material being bonded to said skirt region of said key cap.

4. The apparatus of claim 1 wherein said key cap has a recess behind said face thereof which is bounded by said skirt region of said key cap, said flat panel display being disposed within said recess in parallel relationship with said face of said key cap and wherein said skirt region of said key cap is bonded to said flat panel display by a continuous band of said bonding material which extends around the periphery of said flat panel display within said recess.

5. The apparatus of claim 4 wherein said skirt region of said key cap has an inner surface with a groove thereat which extends around the periphery of said flat panel display, said groove being filled with said bonding material.

6. The apparatus of claim 5 wherein said bonding material is an organic adhesive.

7. The apparatus of claim 4 wherein at least aid skirt region of said key cap is formed of glass and wherein said bonding material is solder glass.

8. The apparatus of claim 7 wherein said skirt region of said key cap is transparent and solder glass is at least partially opaque.

9. The apparatus of claim 1 wherein said flat panel display has a substrate layer overlaid by a layer of spaced apart row busbars and a layer of orthogonally directed column busbars which layers of row busbars and column busbars extend substantially to said edge of said flat panel display and has a driver circuit for applying a voltage difference across particular ones of said row busbars and particular ones of said column busbars, wherein said driver circuit is situated within said key at a location which is behind said substrate.

10. The apparatus of claim 9 wherein said driver circuit includes at least one integrated circuit chip bonded to said substrate and conductive traces thereon which electrically connect busbars with said integrated circuit chip.

11. The apparatus of claim 9 wherein said driver circuit includes four integrated circuit chips bonded to said substrate in parallel relationship therewith and conductive traces thereon which electrically connect busbars with said integrated circuit chips, said integrated circuit chips being arranged in a rectangular pattern wherein a first and a second of said integrated circuit chips are parallel and spaced apart and a third and a fourth of said integrated circuit chips are spaced apart and extend at right angles to said first and second integrated circuit chips, said first and second integrated circuit chips being electrically connected to said row busbars at opposite ends thereof and said third and fourth integrated circuit chips being electrically connected to said column busbars at opposite ends thereof.

12. The apparatus of claim 11 wherein said first integrated circuit chip is electrically connected to alternate ones of said row busbars at first ends thereof and said second integrated circuit chip is electrically connected to the others thereof at opposite ends thereof, said third integrated circuit chip being connected to alternate ones of said column busbars at first ends thereof and said fourth integrated circuit chip being electrically connected the others of said column busbars at opposite ends thereof.

13. The apparatus of claim 11 wherein each of said integrated circuit chips is elongated and has opposite ends and opposite sides, wherein one side of each integrated circuit chip extends along an end of an adjacent integrated circuit chip.

14. The apparatus of claim 11 wherein a circuit board having a front surface and a back surface is situated within said key at a location behind said substrate and is in parallel relationship therewith, and wherein said driver circuit includes four elongated integrated circuit chips secured to said board in parallel relationship therewith, a first and a second of said integrated circuit chips being at said front surface of said board in spaced apart parallel relationship with each other and a second and a third of said integrated circuit chips being spaced apart and being at said back surface of said board in orthogonal relationship with said first and second integrated circuit chips, said first and second integrated circuit chips being electrically connected to the busbars of one of said layers thereof and said third and fourth integrated circuit chips being electrically connected to the busbars of the other of said layers thereof.

15. The apparatus of claim 14 wherein said first integrated circuit chip is electrically connected to alternate ones of the busbars of said one layer thereof, said second integrated circuit chip is connected to the other busbars of said one layer thereof, said third integrated circuit chip is connected to alternate ones of the busbars of said other layer thereof and said fourth integrated circuit chip is connected to the others of said busbars of said other layer thereof.

16. The apparatus of claim 9 further including a circuit board disposed within said key behind said substrate and being in parallel relationship therewith and wherein said driver circuit includes at least one integrated circuit chip secured to said circuit board in parallel relationship therewith, a plurality of conductive traces on said board extending from said integrated circuit chip to an edge of said board, further including a flat strip shaped electrical connector disposed between said edge of said flat panel display and said skirt region of said key cap, said electrical connector having a plurality of parallel spaced apart conductors bonded to a backing strip of flexible insulative material which conductors electrically connect individual ones of said busbars with individual ones of said conductive traces of said circuit board.

17. The apparatus of claim 16 further including an array of light emitters disposed within said key between substrate and said circuit board.

18. The apparatus of claim 9 wherein said flat panel display has an area that is smaller than one square inch.

19. The apparatus of claim 1 wherein a body of moisture impervious material extends through said flat panel display including through said optically active layer thereof, said body of moisture impervious material being bonded to said flat panel display, further including a light emitting component disposed within said body.

20. The apparatus of claim 19 wherein said body of moisture impervious material is a tubular sleeve and wherein said optically active layer of said flat panel display includes an edge seal situated adjacent to said body and extending therearound.

* * * * *